US007905528B2

(12) United States Patent
Marcel

(10) Patent No.: US 7,905,528 B2
(45) Date of Patent: Mar. 15, 2011

(54) SPREADER FRAME FOR CARGO CONTAINER

(76) Inventor: Eric P Marcel, Mamou, LA (US)

( * ) Notice: Subject to any disclaimer, the term of this patent is extended or adjusted under 35 U.S.C. 154(b) by 538 days.

(21) Appl. No.: 11/752,442

(22) Filed: May 23, 2007

(65) Prior Publication Data

US 2008/0290676 A1 Nov. 27, 2008

(51) Int. Cl.
*B66C 1/66* (2006.01)

(52) U.S. Cl. ..... 294/81.53; 294/81.41

(58) Field of Classification Search ..... 294/81.1, 294/81.53, 81.41

See application file for complete search history.

(56) References Cited

U.S. PATENT DOCUMENTS 3,498,665 A * 3/1970 Tauno ..... 294/81.53
3,501,193 A * 3/1970 Gray ..... 294/81.53
3,688,933 A * 9/1972 Rumell ..... 414/608
3,845,527 A * 11/1974 Lombardi ..... 24/575.1
3,888,536 A * 6/1975 Durenec ..... 294/81.53
3,992,050 A * 11/1976 Backteman ..... 294/81.21
4,049,135 A 9/1977 Glassmeyer
4,068,878 A 1/1978 Wilner
4,139,228 A * 2/1979 Varadi ..... 294/82.17
4,258,949 A 3/1981 Keagbine
4,358,145 A * 11/1982 Svensson ..... 294/68.3
4,396,218 A * 8/1983 Stevens ..... 294/81.41
4,401,337 A 8/1983 Simmons
4,444,426 A * 4/1984 Taylor ..... 294/81.53
4,541,662 A 9/1985 Berg
4,648,645 A * 3/1987 Lundgren ..... 294/81.53
4,749,328 A 6/1988 Lanigan, Jr.
4,767,098 A 8/1988 Stinson
4,925,226 A * 5/1990 Leonard et al. ..... 294/82.1
5,257,891 A 11/1993 Baumann et al.
6,113,305 A 9/2000 Takaguchi
6,220,468 B1 4/2001 Lee
6,250,486 B1 6/2001 Enoki
6,598,916 B2 7/2003 Miyazawa
6,685,418 B2 2/2004 Takehara et al.
7,073,673 B2 7/2006 Takehara et al.

* cited by examiner

*Primary Examiner* — Dean J Kramer

(57) ABSTRACT

In embodiments, a spreader frame for hoisting a container having a lifting block is provided which includes a rigid frame structure, a twist lock received by the rigid frame structure, the twist lock being rotated relative to the rigid frame structure between a locked position to engage the lifting block and an unlocked position to disengage from the lifting block, and a safety feature which cooperates with at least one of the rigid frame structure and the twist lock to retain the twist lock in the locked position from being rotated relative to the rigid frame structure absent personnel changing a position of the safety feature.

17 Claims, 17 Drawing Sheets

SPREADER FRAME FOR CARGO CONTAINER

FIELD OF THE INVENTION

The disclosure relates to spreader frames for hoisting cargo containers.

BACKGROUND OF THE INVENTION

Cargo containers (hereinafter "containers") are used for shipping freight on commercial transport carriers such as cargo ships, railcars and trailers. "ISO" containers are a common type of container designed according to ISO (International Standards Organization) specifications which ensure that the containers are inter-operable with compatible carriers. One feature of ISO containers is a hollow lifting block in each corner of the container for securing the container to compatible equipment. The lifting block has a central cavity, and a generally rectangular opening permits access to the cavity from the exterior of the container. In order to secure the container to the compatible equipment, a bayonet or twist lock is inserted into each lifting block and a compatible fitting on the equipment. The twist lock has a spindle section on one end and a wide key section of generally rectangular profile on the end opposite the spindle section. The spindle section is captured by the fitting on the compatible equipment. The key section of the twist lock is inserted through the opening and into the central cavity of the lifting block. The twist lock is twisted or rotated ninety degrees about the spindle axis and relative to the cavity walls between an open position and an engaged position. The open position permits the rectangular key section to be inserted through and freely removed from the rectangular opening of the lifting block. When rotated to the engaged position, the rectangular key section engages the lifting block and permits vertical force to be applied to the lifting block for hoisting the container.

In some terminal facilities, dedicated and specially designed high-speed handling equipment is used to rapidly hoist and move high volumes of ISO containers between carriers or between a dock and carrier. High speed handling equipment designed for hoisting containers can include automated or remotely controlled twist locks for engaging the container, or automated grapple arms for grabbing the container. Such high speed handling equipment is dedicated solely for handling containers and is not useful in a terminal facility where other loads must also be moved. High speed handling equipment for containers also requires a large footprint for operation. High speed handling equipment for containers also requires a large capital investment.

In view of the foregoing, many terminal facilities have only a general purpose crane or hoist equipment (hereinafter "hoist equipment") for handling ISO containers, non-ISO containers and other loads. Off-shore oil platforms are examples of terminal facilities where containers are handled with general purpose hoist equipment. As used herein, "hoist equipment" includes any overhead hoist equipment or crane providing a single point lift or having a hoist cable and terminal fitting, such as a hook, which is raised and lowered to move a load such as a container. A container or load to be hoisted is manually attached to the hook, such as by using wire rope slings. In some terminal facilities, empty containers are attached directly to the wire rope slings and raised. However, using this type of direct attachment to hoist a container is dangerous and can subject the container to stresses which damage the container or cause immediate failure of the container. These dangers and the risk of damaging the container are greatly increased when the container is loaded. Hoisting a container carrying a cargo load that has uneven distribution of weight throughout the container is more dangerous and further increases the risk of damaging the container.

Moving containers from a supply boat to an off-shore oil platform with general purpose hoist equipment can be particularly dangerous and presents a greater risk of damaging the container. The danger and risk are compounded by motion of the supply boat relative to the oil platform and hoist due to waves, wind and surface currents. Due to motion of the supply boat, the container on the deck of the supply boat when attached to the hoist can be jerked and subjected to additional stress in the form of sudden horizontal and vertical forces. When clear of the deck of the supply boat, the container can swing and hit projecting structure within the tight confines of the oil platform before coming to rest on the oil platform. Similar forces can be encountered when moving containers from the oil platform to the supply boat.

General purpose hoist equipment can be used to safely hoist a loaded container with a spreader frame attached to the hook and to the container. The spreader frame is adapted to permit the container to be hoisted without exposing the container to excessive bending stress and without applying horizontal forces to the container and twist locks. The spreader frame has a rigid frame structure which is attached to the hoist hook by a set of wire rope slings. The spreader frame includes four twist locks on the rigid frame structure at locations corresponding to the lifting blocks of the container. The twist locks are received in the lifting blocks and thus attach the container to the spreader frame. When the spreader frame is hoisted by operation of the hoist equipment to raise the hook, both vertical and horizontal force components are transmitted through the wire rope slings to the rigid frame structure. The rigid frame structure absorbs horizontal force components, such that only vertical forces are transmitted to the container by the twist locks attaching the container to the rigid frame structure of the spreader frame. The rigid frame structure supporting the twist locks and container attached thereto also reduces bending stress on the container.

A problem associated with hoisting ISO containers with a spreader frame is that one or more of the twist locks can be unintentionally or accidentally rotated to the open position before the spreader frame and attached container are hoisted, or while the spreader frame and attached container are suspended from the hoist. Hoisting a spreader frame with the container secured thereto by only three or fewer twist locks can be dangerous and risks damaging the container, cargo, equipment and personnel.

Gross weight capacity is one limiting mechanical factor of containers. Increasing gross weight causes increased bending stress on the container walls when the loaded container is hoisted from a resting position.

Overall length is a limiting mechanical factor for containers. Increasing overall length causes increased bending stress on the container walls when the container is hoisted from a resting position, particularly when the container is loaded.

Bending stress is a limiting mechanical factor for containers. Bending stress causes deflection of the container walls when the loaded container is hoisted from a resting position, particularly of the longitudinal walls extending between the ends of the container. Excessive bending stress can cause the container walls to fail by buckling.

For the reasons stated above, and for other reasons stated below which will become apparent to those skilled in the art upon reading and understanding the present specification, there is a need in the art for an improved spreader frame for hoisting cargo containers.

BRIEF DESCRIPTION OF THE INVENTION

The above-mentioned shortcomings, disadvantages and problems are addressed herein, which will be understood by reading and studying the following specification.

In one aspect, the disclosure provides an improved spreader frame. In another aspect, the disclosure provides an improved twist lock. In another aspect, the disclosure provides a safety feature for a spreader frame.

Apparatus of varying scope are described herein. In addition to the aspects and advantages described in this summary, further aspects and advantages will become apparent by reference to the drawings and by reading the detailed description that follows.

DETAILED DESCRIPTION OF THE INVENTION

In the following detailed description, reference is made to the accompanying drawings that form a part hereof, and in which is shown by way of illustration specific embodiments which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Figure 1:
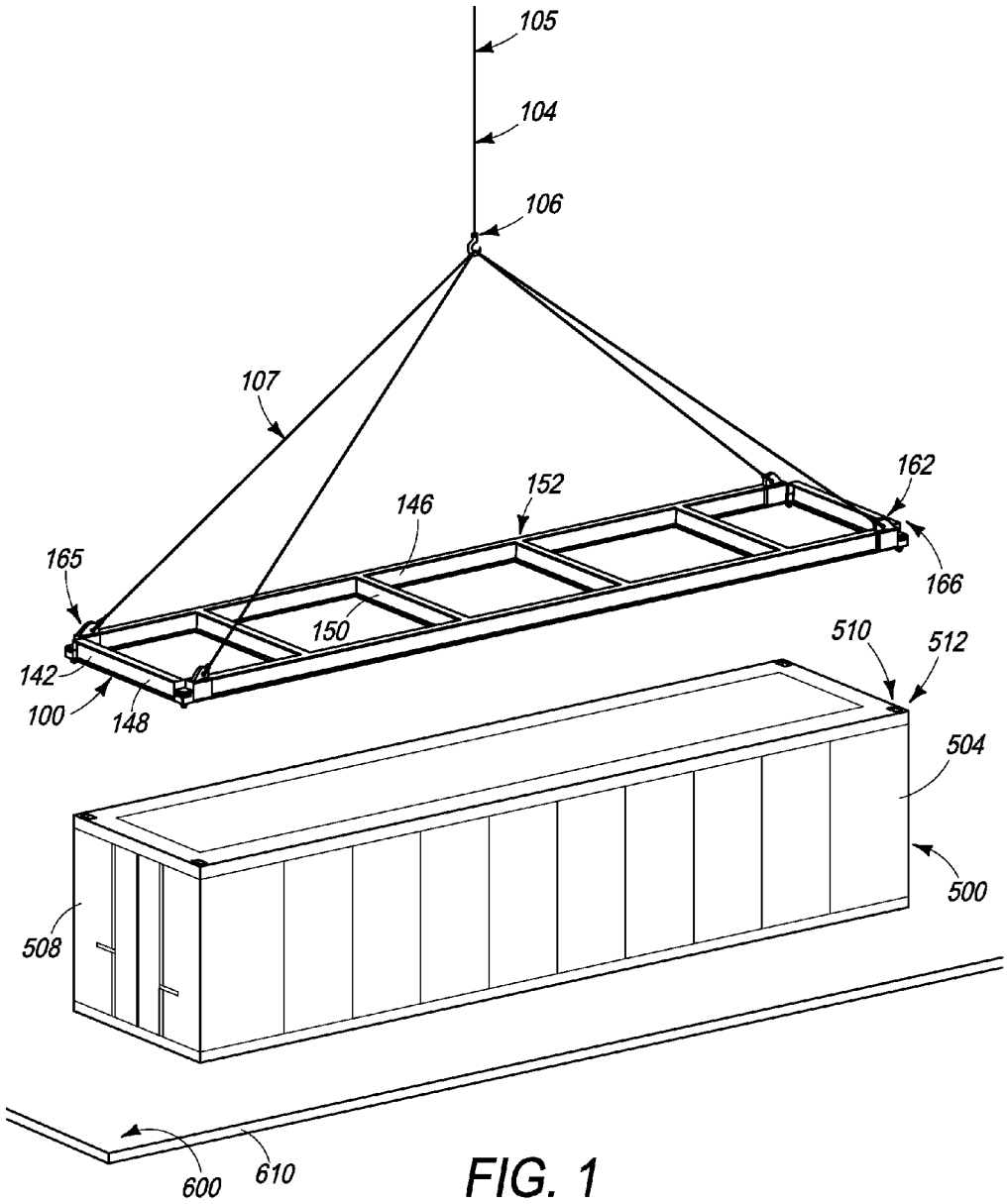
FIG. 1 is a perspective view of a spreader frame according to an embodiment.

FIG. 1 is a perspective view of a spreader frame 100 according to an embodiment. Spreader frame 100 is adapted to support a container 500. In the specific embodiment illustrated, container 500 is an ISO container. In other embodiments, container 500 can be of different design. Container 500 is a box structure formed by cooperation of four longitudinal walls 504 and spaced end walls 508. One or both of the end walls 508 can include a door (not shown) providing access to interior space (not shown) of container 500. Container 500 includes a hollow lifting block 510 on each corner 512 for securing the container 500 to compatible equipment. The lifting block 510 has a central cavity. The lifting block 510 also has a generally rectangular opening which permits access to the central cavity.

Spreader frame 100 is adapted to be attached to container 500 for hoisting the container 500, as further described herein. In the specific embodiment shown in FIG. 1, spreader frame 100 is suspended above container 500 prior to being attached thereto. Container 500 initially rests upon and is supported by support surface 600. In the specific embodiment illustrated, support surface 600 is a deck 610 of a supply ship engaged in supplying an off-shore oil platform. In other embodiments, the support surface 600 can be any suitable terminal facility floor or deck, or a carrier such as a railcar or trailer.

Spreader frame 100 is adapted to be hoisted and moved by hoist equipment 104. As used herein, "hoisted" means raised or lowered using hoist equipment. It is to be understood that any suitable hoist equipment 104 can be used with spreader frame 100. For example, hoist equipment 104 can include a hoist, crane, lifting equipment having a hoist or lift cable, overhead crane, overhead hoist, hoist supported on an overhead trolley, hoist supported on a rail or boom, single point lift, or any suitable equipment having a hoist cable. Hoist equipment 104 is operable for hoisting and moving the spreader frame 100 having container 500 attached thereto (see FIG. 2). In the specific embodiment illustrated, hoist equipment 104 includes a hoist cable 105 having a hook 106 at a terminal end thereof. It is to be understood that hook 106 can include any suitable terminal fitting adapted for use with hoist equipment 104. For example, hook 106 can include a clasp and pin combination, a D-ring fitting, or a terminal loop of hoist cable 105. Hoist equipment 104 includes a hoist drum (not shown) operable for reeling and unreeling the hoist cable 105 to raise and lower hook 106 in the vertical direction.

Figure 2:
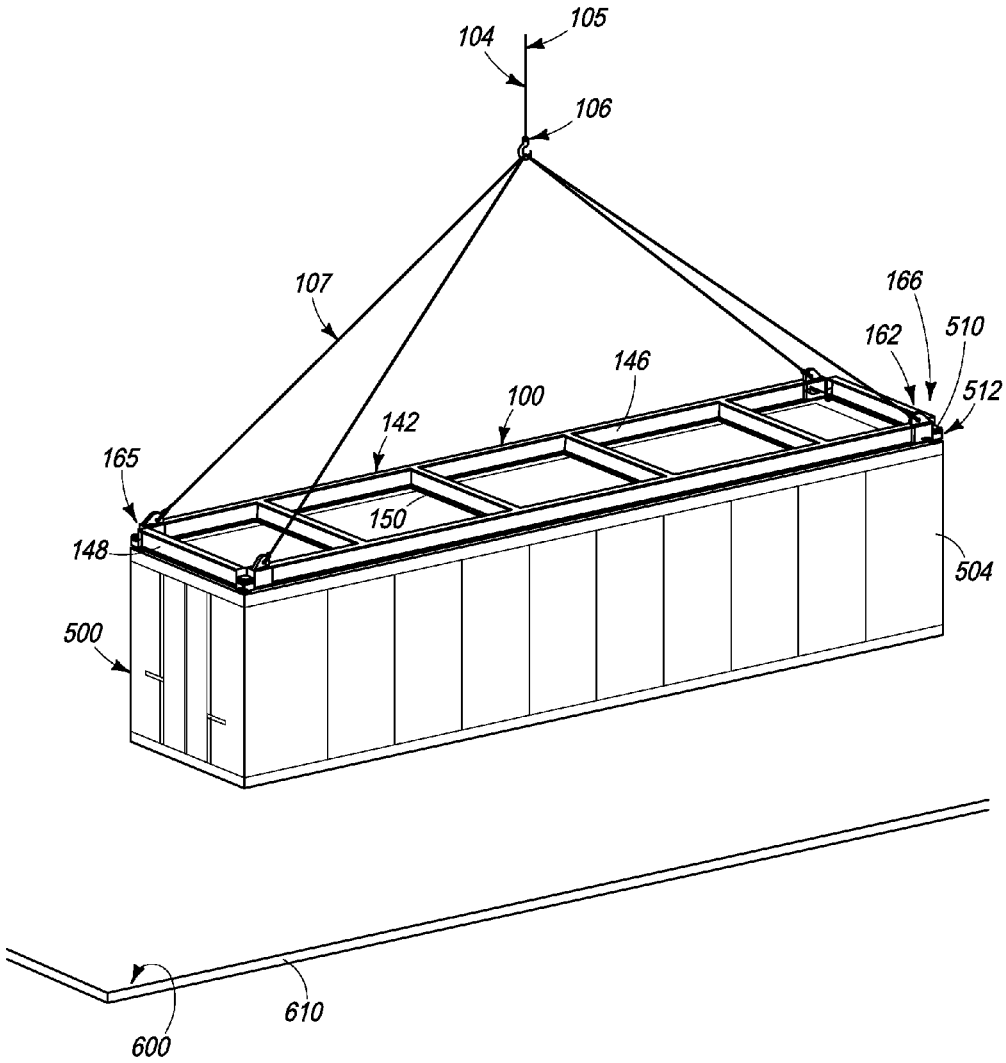
FIG. 2 is a perspective view of the spreader frame of FIG. 1, showing the spreader frame and a cargo container attached thereto.
Figure 3:
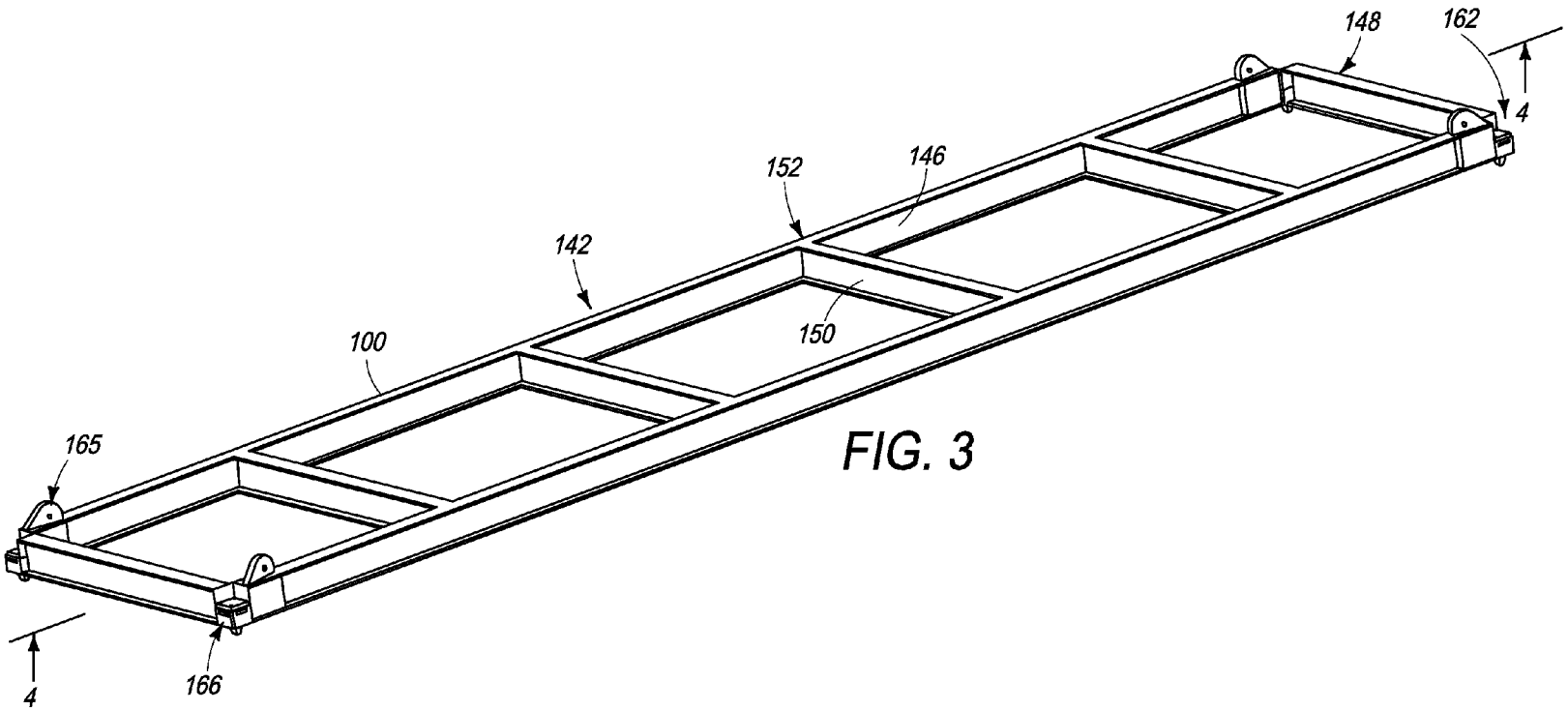
FIG. 3 is an enlarged perspective view of the spreader frame shown in FIG. 1.
Figure 4:
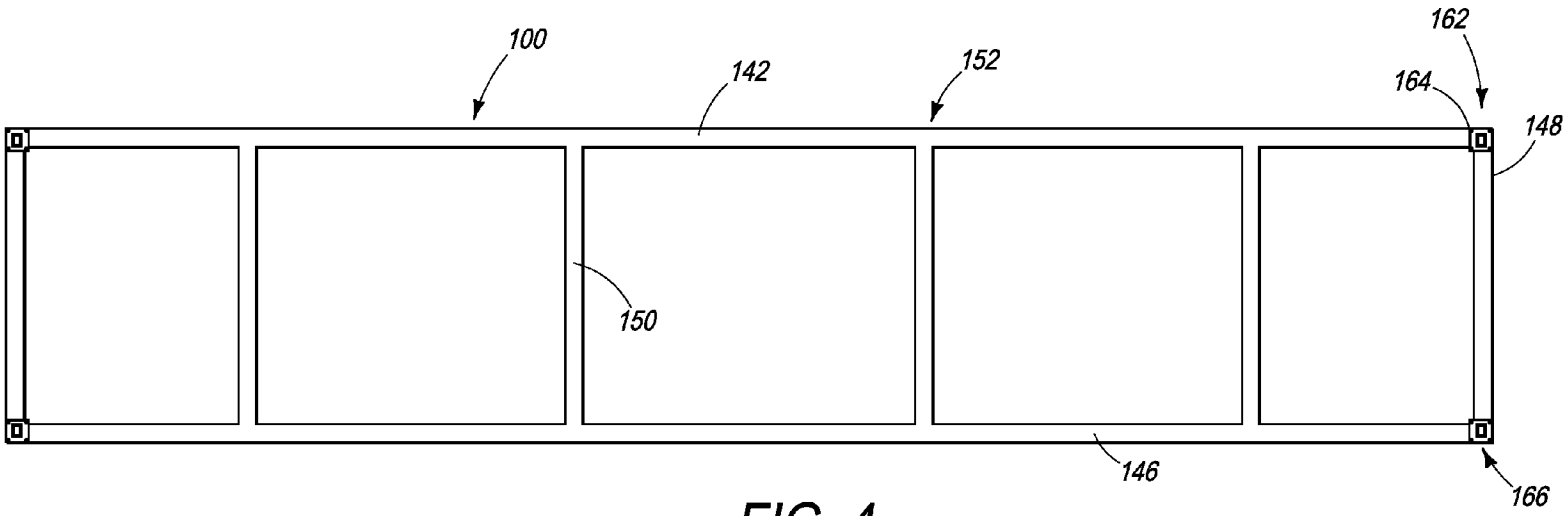
FIG. 4 is a bottom plan view taken generally along line 4-4 in FIG. 3.

FIG. 2 is a perspective view of the spreader frame 100 of FIG. 1. FIG. 2 shows the spreader frame 100 attached to and supporting container 500. Container 500 thus is hoisted above support surface 600. Spreader frame 100 includes a rigid frame structure 142. Rigid frame structure 142 has suitable mechanical strength to support with an adequate safety factor the container 500 when fully loaded. As used herein, "fully loaded" means that the container is loaded to maximum gross capacity. It is to be understood that the rigid frame structure 142 can be constructed in any manner suitable to provide mechanical strength adequate to support the container 500 when fully loaded. In the specific embodiment illustrated, the rigid frame structure 142 includes a pair of parallel elongated longitudinal frame members 146. The rigid frame structure 142 includes a spaced pair of parallel end members 148 joining the pair of longitudinal frame members 146 at opposite ends thereof. Each end member 148 extends between the pair of longitudinal frame members 146 in perpendicular relation thereto. The end members 148 and longitudinal frame members 146 thus cooperate to define a generally rectangular outer perimeter having four corners 162 disposed respectively in two opposite pairs. Intermediate the pair of end members 148 and parallel thereto, the rigid frame structure 142 includes a plurality of generally equidistant, spaced, parallel cross-members 150 joining the pair of longitudinal frame members 146. The cross-members 150 extend between the pair of longitudinal frame members 146 in perpendicular relation thereto. In the specific embodiment illustrated, the rigid frame structure 142 includes six cross-members 150. The cross-members 150 are joined to the longitudinal frame members 146 in a suitable manner. In the specific embodiment illustrated, intermediate the ends 148 four of the cross-members 150 each abut the longitudinal frame members 146 and are joined thereto at respective welded 'T" joints 152. In the illustrated embodiment, two of the cross-members 150 are joined at respective corners 162 to the ends 148 of the longitudinal frame members 146 by welded joints and respective braces or gussets 164 (see FIG. 4). Gussets 164 form an overlapping layer which overlaps adjacent portions of the longitudinal frame members 146 and cross-members 150. According to the disclosure, the cross-members 150 and ends 148 of longitudinal frame members 146 are joined at corners 162 in any suitable manner. Longitudinal frame members 146 and cross-members 150 are formed of any suitable rigid material having adequate mechanical strength. In the specific embodiment illustrated, the longitudinal frame members 146 and cross-members 150 are formed of carbon steel having a rectangular cross-sectional profile.

The spreader frame 100 includes a plurality of security housings 166 located in alignment with the lifting blocks 510 at the uppermost four corners 512 of container 500. In the specific embodiment illustrated, the spreader frame 100 includes four security housings 166 each located at respective corners 162 of the rigid frame structure 142 in alignment with the respective lifting blocks 510 of container 500. It is to be understood that in other embodiments (not shown), the spreader frame 100 can include security housings 166 at other locations, such as at the T joints 152, for being connected to differently proportioned containers. For example, it is anticipated that security housings 166 can be located to accommodate containers having nominal lengths of ten and twenty feet, as well as the forty foot container illustrated herein. In the illustrated embodiment, at each corner 162 the respective security housing 166 is intermediate and adjacent the respective cross-member 150 and end 148 of longitudinal frame member 146. In the specific embodiment illustrated, the security housing 166 at corner 162 is intimately joined by welded joints to cross-member 150, end 148, and overlapping gusset 164.

Each security housing 166 includes four adjoining sidewalls 170 and a bottom 174 which cooperate to form an interior compartment 178. Cooperation of the sidewalls 170 forms a continuous, recessed upper lip 182. The upper lip 182 has therein a plurality of spaced anchor holes 186 threaded to receive anchor bolts 190. In the specific embodiment illustrated, the upper lip 182 has therein four anchor holes 186. The bottom 174 has a center 194. A circular opening 198 is located at the center 194. The circular opening 198 forms open bore 202 having a vertical axis 204 extending in the vertical direction through the center 194 of bottom 174.

The interior compartment 178 of each security housing 166 includes a first rest 206. The first rest 206 is adapted to stop a locking member 210 of a twist lock 214 (see FIG. 15) in a locked position, as further described herein. It is to be understood that the first rest 206 can be of any design suitable to stop the locking member 210 in the locked position, and other specific constructions are anticipated by the present disclosure. In the specific embodiment illustrated, the first rest 206 engages and mates with the locking member 210 in the locked position.

Figure 6:
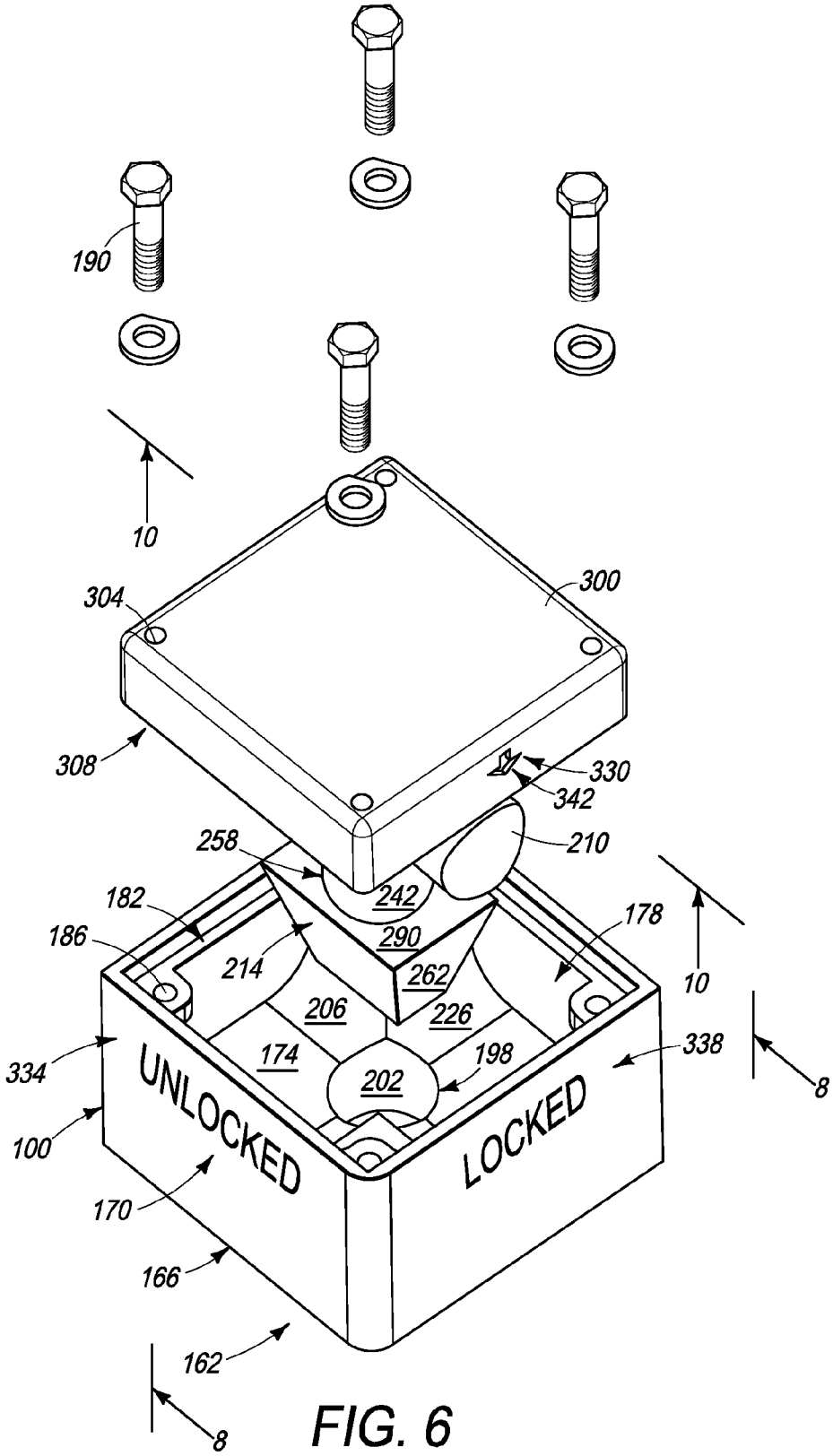
FIG. 6 is an exploded partial top perspective view of the twist lock, security housing, security cover and visual indicia shown generally in FIG. 5.
Figure 7:
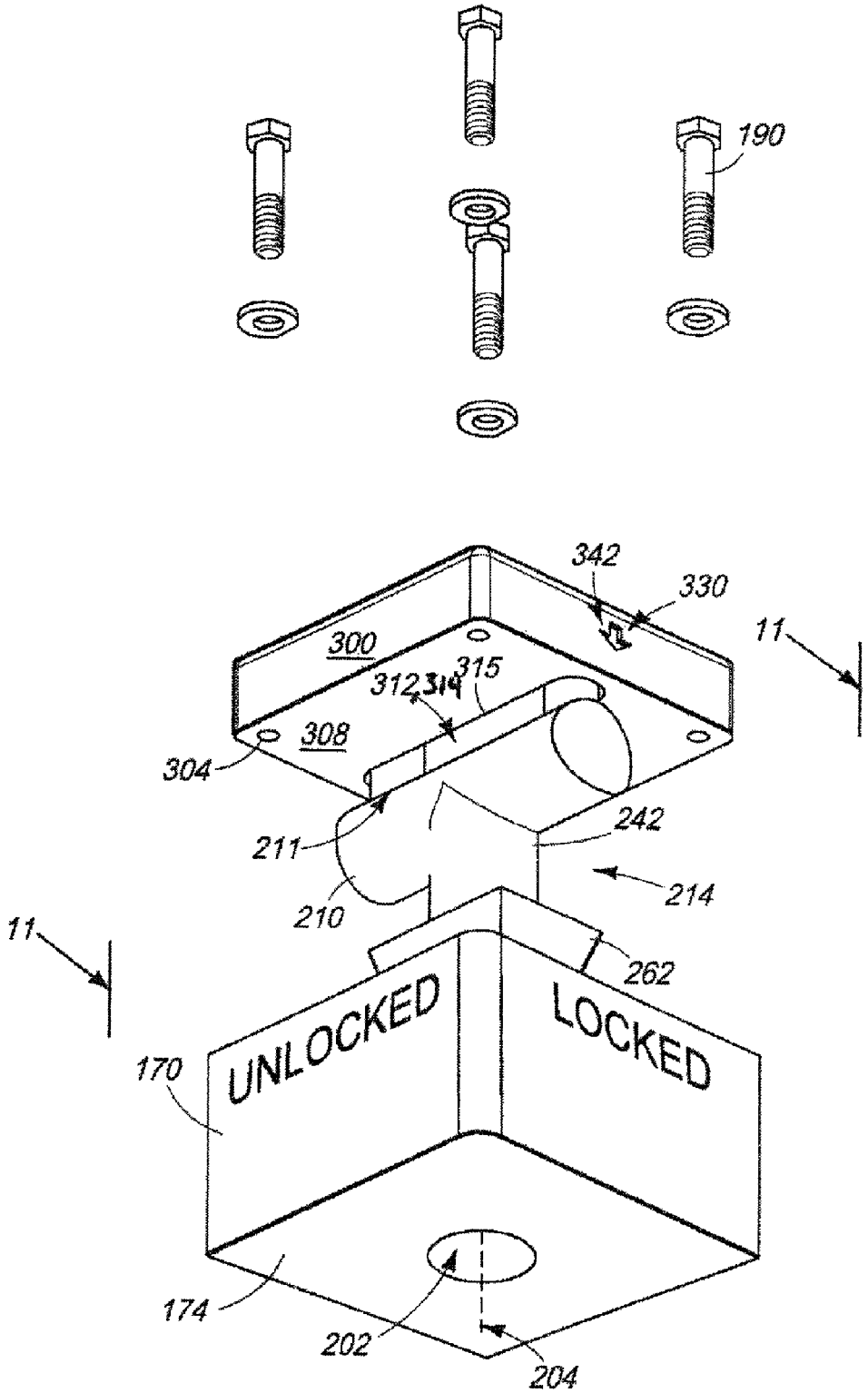
FIG. 7 is an exploded partial bottom perspective view of the twist lock, security housing, security cover and visual indicia shown in FIG. 6.
Figure 8:
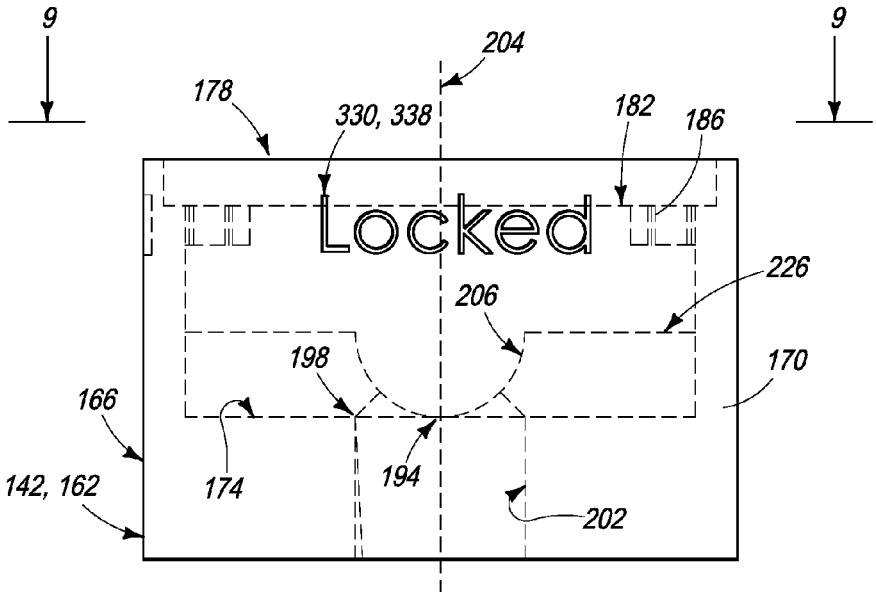
FIG. 8 is a front partial section view of the security housing and visual indicia shown generally in FIG. 6, with the twist lock omitted for clarity.
Figure 9:
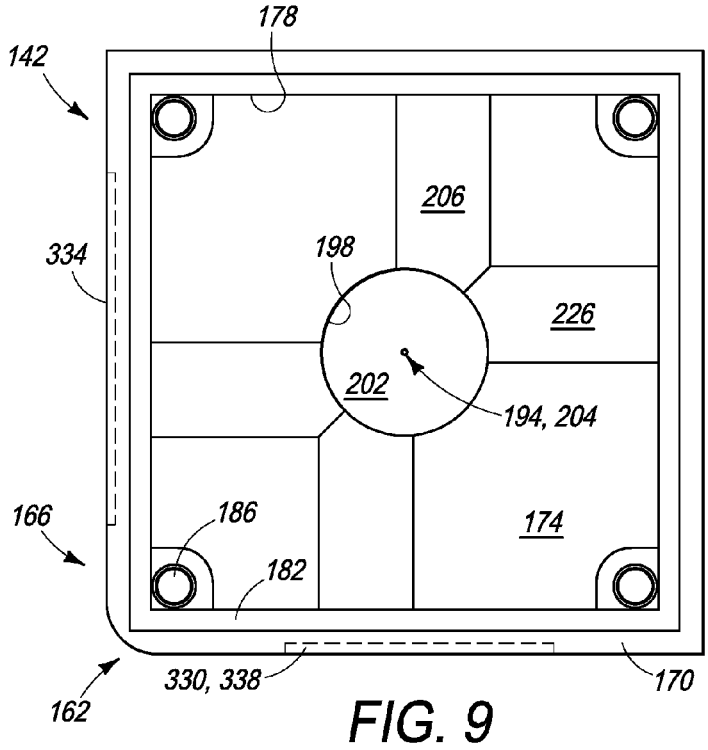
FIG. 9 is a top view, partially in section, of the security housing and visual indicia taken generally along line 9-9 in FIG. 8.
Figure 10:
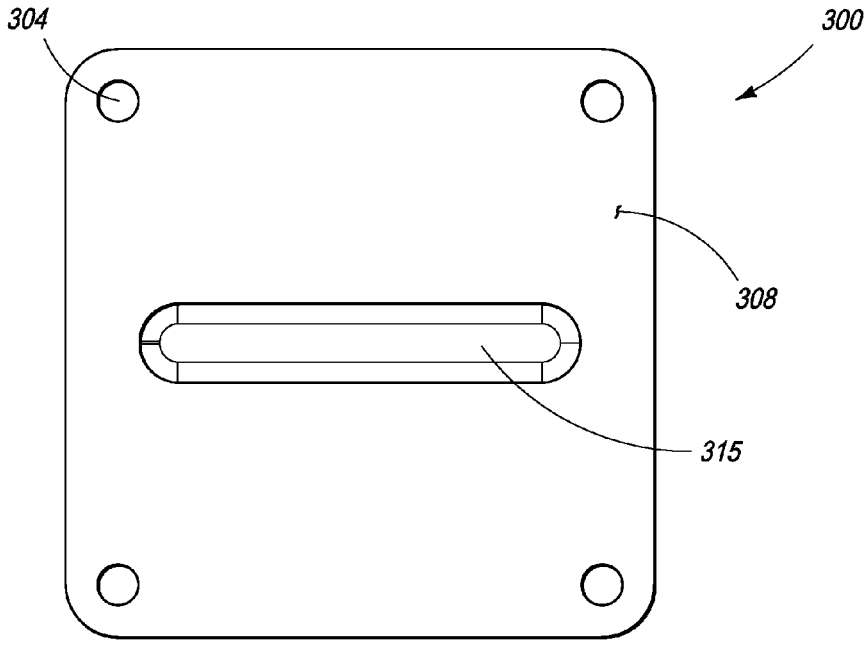
FIG. 10 is a bottom view of the security cover shown generally in FIG. 6.

The interior compartment 178 of each security housing 166 includes a second rest 226. The second rest 226 is adapted to stop the locking member 210 of the twist lock 214 (see FIG. 6) in an unlocked position, as further described herein. It is to be understood that the second rest 226 can be of any design suitable to stop the locking member 210 in the unlocked position, and other specific constructions are anticipated by the present disclosure. In the specific embodiment illustrated, the second rest 226 engages and mates with the locking member 210 in the unlocked position. The second rest 226 and first rest 206 form a ninety degree angle.

The spreader frame 100 includes a plurality of twist locks 214. In the specific embodiment illustrated, the spreader frame includes four twist locks 214 each corresponding to a respective security housing 166 at each corner 162 of rigid frame structure 142. Each twist lock 214 includes the locking member 210. Locking member 210 is adapted to be engaged by the first rest 206 of the security housing 166 in the locked position. Alternatively, locking member 210 is adapted to be engaged by the second rest 226 of the security housing 166 in the unlocked position. Locking member 210 has a projection 213. Projection 213 extends in the vertical direction above the upper lip 182 and has an elongated upper edge 211. Upper edge 211 is received in a retaining recess 312 of security cover 300 when locking member 210 is received in first rest 206 or second rest 226. The upper edge 211 of projection 213 of locking member 210 extending above the upper lip 182 thus defines a first safety feature 215 of twist lock 214.

The twist lock 214 includes a spindle section 242 joined in fixed relationship to the locking member 210. The spindle section 242 is a solid column 246 joined at an upper end 250 thereof to the locking member 210. The spindle section 242 has a vertical spindle axis 254 which intersects locking member axis 212 of locking member 210. The solid column 246 also defines a lower end 258 of spindle section 242 spaced from upper end 250.

Twist lock 214 includes a key section 262 joined in fixed relation to spindle section 242 at lower end 258. Key section 262 includes key upper end 266 joined to the lower end 258 of spindle section 242. Key section 262 also has a key lower end 270 spaced from key upper end 266. Key lower end 270 defines a lower terminal end 274 of twist lock 214. Key upper end 266 has a generally rectangular cross sectional profile and an upper width 278. Key lower end 270 has a generally rectangular cross sectional profile and a lower width 282. Upper width 278 of key upper end 266 is greater than the lower width 282 of key lower end 270. Key section 262 thus has a rectangular cross sectional profile which tapers from upper width 278 to lower width 282. Lower terminal end 274 terminates at a flat lower surface 286. Flat lower surface 286 is perpendicular to vertical spindle axis 254. Key section 262 at key upper end 266 includes a generally flat key upper surface 290. Key upper surface 290 is spaced above lower surface 286 and in general opposition thereto.

Spreader frame 100 includes a security cover 300. Security cover 300 is adapted to enclose interior compartment 178 of security housing 166 having locking member 210 therein. It is to be understood that security cover 300 can be mounted to enclose interior compartment 178 in any suitable manner. In the illustrated embodiment, security cover 300 is adapted to be mounted flush on upper lip 182 of security housing 166 and thus to enclose interior compartment 178 having locking member 210 therein. In the specific configuration illustrated, security cover 300 is adapted to be secured on upper lip 182 of security housing 166 by a plurality of threaded security bolts 190 received in respective anchor holes 186 of upper lip 182. The security cover 300 has therein bolt holes 304 for receiving the security bolts 190. The security cover 300 has a generally planar bottom surface 308 facing the interior compartment 178. The bottom surface 308 is flush mounted in mating relationship with the upper lip 182 and secured thereto by threading the security bolts 190 into anchor holes 186. The bottom surface 308 has therein an elongated retaining recess 312. Retaining recess 312 is dimensioned to receive and retain in intimate mating relationship the elongated upper edge 211 of projection 213 of locking member 210. Retaining recess 312 retaining the upper edge 211 of projection 213 of locking member 210 thus defines a second safety feature 314 of security cover 300. The second safety feature 314 of safety cover 300 cooperates with the first safety feature 215 of twist lock 214 to retain twist lock 214 either in the locked position with the locking member 210 engaged with first rest 206 or alternatively in the unlocked position with the locking member 210 engaged with the second rest 226. The second safety feature 314 of safety cover 300 thus cooperates with the first safety feature 215 of twist lock 214 in the locked position and with the security housing 166 of rigid frame structure 142 to lock together spreader frame 100 and container 500. The second safety feature 314 of safety cover 300 cooperates with the first safety feature 215 of twist lock 214 in the unlocked position and with the security housing 166 of rigid frame structure 142 to release spreader frame 100 from container 500. It is to be understood that first and second safety features 214,315 and security housing 166 can be configured differently in other embodiments (not shown). For example, it is anticipated that security cover 300 can include a retaining recess or projection, and twist lock 214 can include the other of a retaining recess or projection. Also, it is anticipated that in other embodiments at least one of security housing 166, security cover 300 and twist lock 214 can include a safety feature which retains twist lock 214 in the locked position or alternatively retains twist lock 214 in the unlocked position. In view of the foregoing, it is to be understood that according to one embodiment of the present disclosure, at least one of the rigid frame structure, twist lock, and security cover can include a safety feature which retains twist lock 214 in the locked position or alternatively retains twist lock 214 in the unlocked position. Further, it is to be understood that security housing 166 of rigid frame structure 142 cooperates with security cover 300 and security bolts 190 to prevent incidental access or ready access to twist lock 214 by personnel working without deliberate use of a tool, such as a wrench, adapted to remove security bolts 190 from threaded anchor holes 186. Likewise, it is to be understood that security housing 166 of rigid frame structure 142 cooperates with security cover 300 and security bolts 190 to prevent enclosing twist lock 214 by incidental replacement of security cover 300 with security bolts 190 by personnel working without deliberate use of a tool, such as a wrench, adapted to tighten security bolts 190 in threaded anchor holes 186.

Spreader frame 100 includes visual security indicia 330. It is to be understood that any suitable visual security indicia 330 can be provided. In the specific embodiment illustrated, visual security 330 is adapted to provide personnel a visual indication that each twist lock 214 is securely retained or locked in the unlocked position or alternatively in the locked position. Visual security indicia 330 includes an unlocked position label 334 stamped on one of the sidewalls 170 of security housing 166 corresponding to the unlocked position of locking member 210 and twist lock 214. Visual security indicia 330 includes a locked position label 338 stamped on an alternate one of the sidewalls 170 of security housing 166 corresponding to the locked position of locking member 210 and twist lock 214. Visual security indicia 330 include an indicator arrow 342 stamped on security cover 300 in general alignment with the longitudinal axis of retaining recess 312. When security cover 300 is oriented in the first position corresponding to the unlocked position of twist lock 214 and the position of locking member 210 against the first rest 206, and the upper edge 211 of the projection 213 locking member 210 is received in retaining recess 312, the indicator arrow 342 aligned with retaining recess 312 points to the unlocked position label 334. Alternatively, when security cover 300 is oriented in the second position 320 corresponding to the locked position of twist lock 214 and to the locked position of locking member 210 against second rest 226, and the upper edge 211 of the locking member 210 is received in retaining recess 312 aligned with the locked position of locking member 210, the indicator arrow 342 aligned with retaining recess 312 points to the locked position label 338. Observation of the indicator arrow 342 in relation to the open indicator label 334 and locked indicator label 338 thus provides personnel a visual indication that each twist lock 214 is securely locked in the open position or alternatively in the locked position.

The container 500 is attached to the spreader bar 100 by aligning the security housings 166 at corners 162 of spreader frame 100 with the lifting blocks 510 at the corners 512 of container 500. At each corner of the spreader frame 100, the security bolts 190 and security cover 300 are initially removed from the upper lip 182 of the sidewalls 170 of the security housing 166 to provide access to the interior compartment 178. A twist lock 214 is rotated to the open position, and the key section 262 is inserted in the vertical direction through the open bore 202 in the bottom 174 of security housing 166, through the aligned rectangular opening 516 and received in the central cavity 514 of the respective lifting block 510. The twist lock 214 is rotated ninety degrees to the locked position, and the locking member 210 is received against the second rest 226 in the locked position. The security cover 300 is rotated to the second orientation corresponding to the locked position of the locking member 210, such that the retaining recess 312 is aligned with the upper edge 211 of locking member 210. The security cover 166 is lowered such that the upper edge 211 is received in the retaining recess 312 and permits the security cover 300 to be flush mounted on the upper lip 182 of security housing 166 by returning and tightening the security bolts 190 in the anchor holes 186. With the security cover 300 flush mounted on the upper lip 182, the indicator arrow 342 points to the locked position label 338 and thus provides visual indication to personnel that twist lock 214 is secured in the locked position. In the locked position of the twist lock 214, the key section 262 is rotated inside the central cavity 514 to a respective locked position engaging the lifting block 510 in a known manner to permit vertical force to be applied to the lifting block 510 and thus to container 500. Spreader frame 100 is attached to the hook 106 of hoist equipment 104 by a set of wire rope slings 107. Each wire rope sling 107 has an end attached to the hook 106 and an opposite end attached to a respective eye 165 on the rigid frame structure 142. The hoist 104 is operated to lift the hook 106 and thus raise the spreader frame 100 having container 500 attached thereto. The lifting blocks 510 of container 500 are supported by the key section 262 of the respective twist locks 214. The locking member 210 is retained against the second rest 226 by cooperation of the security cover 300 and upper lip 182 joined by the security bolts 190 threaded into the anchor holes 186. The security cover 300 must be rotated to the second orientation in order to align and permit the retaining recess 312 to receive the upper edge 211 of locking member 210. With the security cover 300 secured by the security bolts 190 threaded into the anchor holes 186, the indicator arrow 342 points to the locked position label 338 and thus provides personnel visual indication that the container 500 is locked to the spreader frame 100 by the twist lock 214.

The spreader frame 100 is released from container 500 by using a tool to remove security bolts 190 from anchor holes 186, removing security cover 300 from upper lip 182, rotating twist lock 214 to the unlocked position with locking member 210 engaging second rest 226, turning security cover ninety degrees to the first orientation with the indicator arrow 342 indicating the unlocked position label 334, returning security cover 300 to upper lip 182 such that upper edge 211 of projection 213 is retained in retaining recess 312, and using a tool to tighten security bolts 190 in anchor holes 186.

Figure 15:
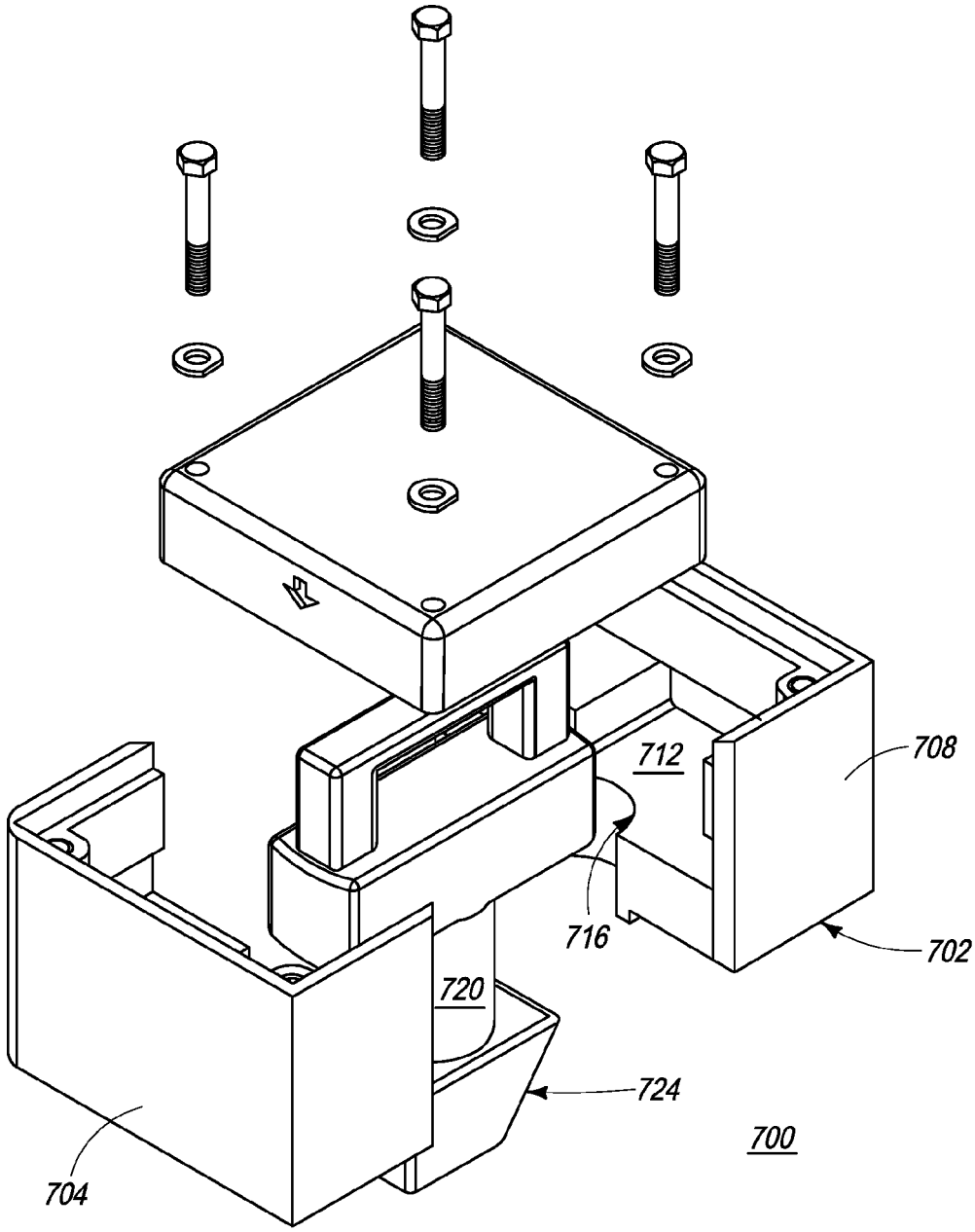
FIG. 15 is an exploded partial perspective view of the twist lock, security housing security cover and visual indicia in a first alternative embodiment.

FIG. 15 is an exploded partial perspective view of the twist lock, security housing security cover and visual indicia in a first alternative embodiment. Spreader frame 700 shown in FIG. 15 is identical to previously described spreader frame 100 except as specified herein. Spreader frame 700 includes a rigid frame structure (not shown) having a plurality of security housings 702 each located at the respective corners thereof. Security housing 702 includes and is formed by cooperation of housing first section 704 and housing second section 708 joined in fixed relation thereto. Housing first section 704 and housing second section 708 each include a respective portion of bifurcated bottom 712 having opening 716 therein. The bifurcated bottom 712 and opening 716 permit spindle section 720 of twist lock 724 to be installed in opening 716 before housing first section 704 and housing second section 708 are permanently joined in fixed relation. With spindle section 720 installed in the opening 716 of bottom 712, housing first section 704 and housing second section 708 are permanently joined in intimate fixed relation and thus permanently capture the twist lock 724. Housing first section 704 and housing second section 708 can be permanently joined in any suitable manner and, in the illustrated embodiment, are welded. Housing first section 704 and housing second section 708 when permanently joined cooperate to form the security housing 702. Housing first section 704 and housing second section 708 are joined to the longitudinal members (not shown in FIG. 15) and cross members (not shown in FIG. 15) in integral fixed relation thereto in a manner which ensures structural integrity of the rigid frame structure.

Figure 5:
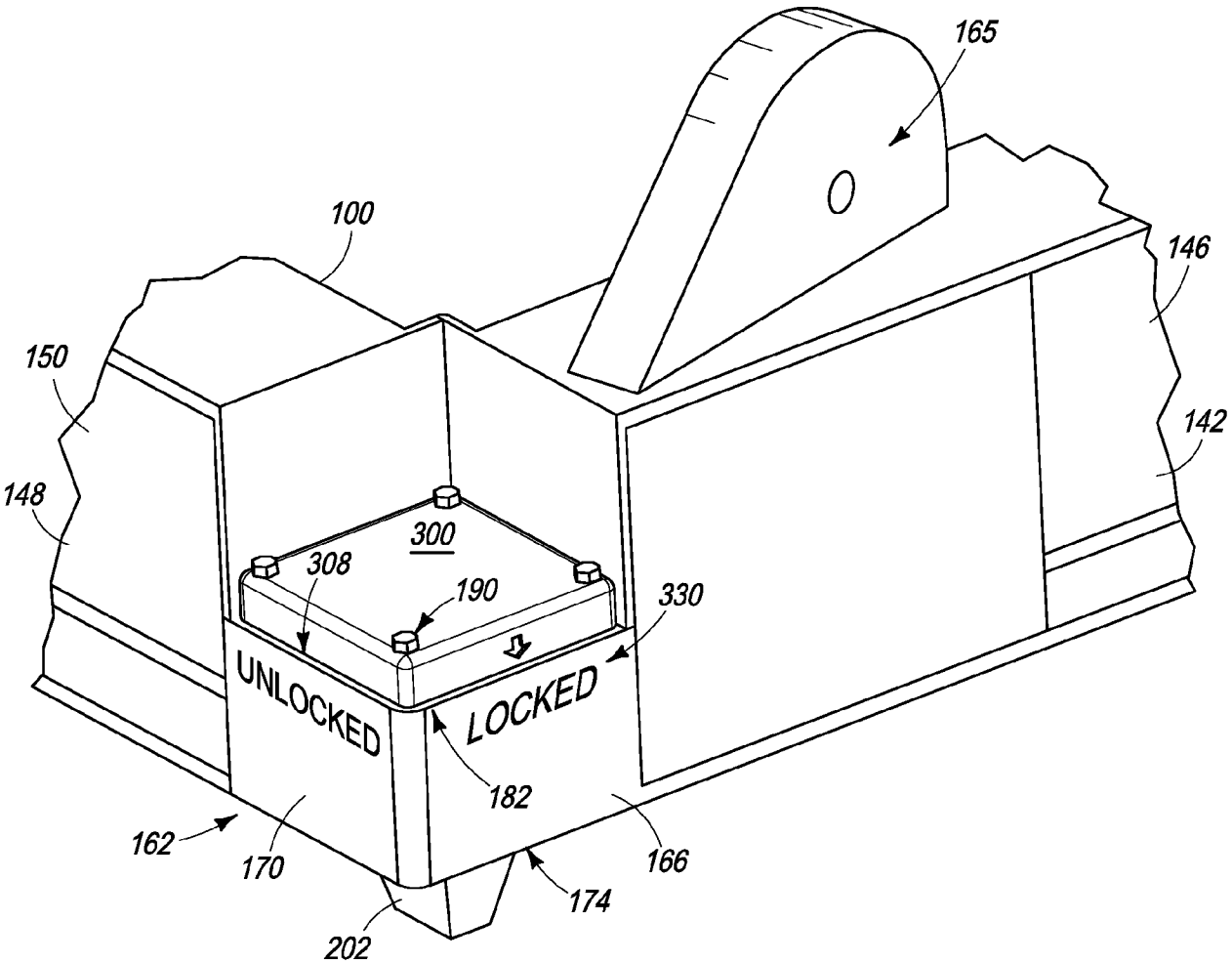
FIG. 5 is an enlarged partial perspective view of a corner of the spreader frame of FIG. 3, showing the twist lock, security cover, security housing, and visual indicia in the locked condition.
Figure 16:
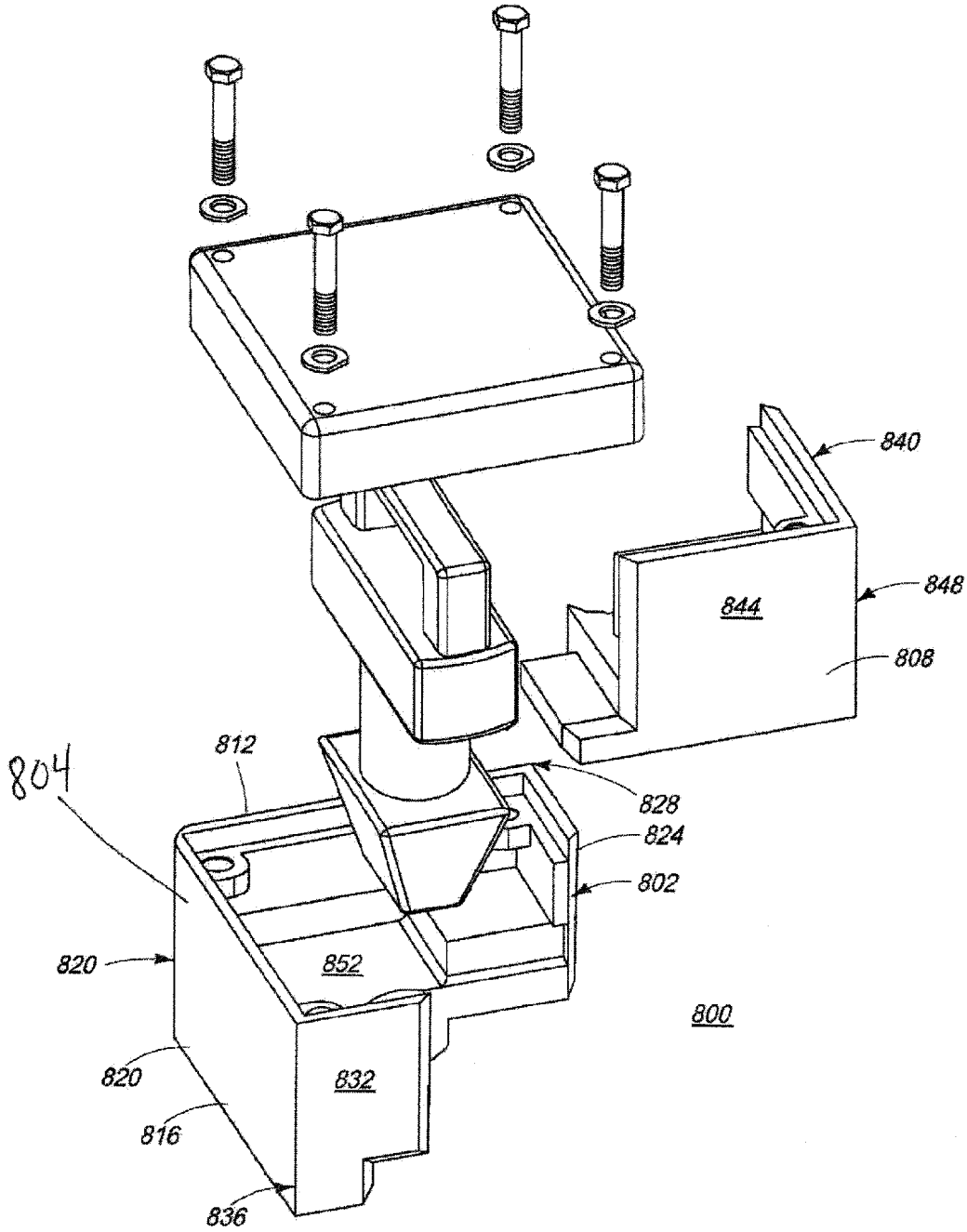
FIG. 16 is an exploded partial perspective view of the twist lock, security housing security cover and visual indicia in a second alternative embodiment.

FIG. 16 is an exploded partial perspective view of the twist lock, security housing, security cover and visual indicia in a second alternative embodiment. Spreader frame 800 shown in FIG. 16 is identical to previously described spreader frame 700 except as specified herein. Spreader frame 800 includes a rigid frame structure (not shown) having a plurality of security housings 802 each located at the respective corners thereof. Security housing 802 includes and is formed by cooperation of housing first section 804 and housing second section 808 joined in fixed relation thereto. Housing first section 804 includes wall sections defining three adjacent corners of the housing 802, as further specified. Housing first section 804 includes first inner wall 812. Housing first section 804 includes second inner wall 816 which intersects first inner wall 812 at inner corner 820. It is to be understood, in the illustrated embodiment, that inner corner 820 is proximate the innermost intersection of the respective longitudinal member (not shown in FIG. 16) and cross member (not shown in FIG. 16) at the respective corner formed thereby, as generally illustrated in FIG. 5. Housing first section 804 includes a first outer wall portion 824. First outer wall portion 824 intersects first inner wall 812 at respective first intermediate corner 828. Housing first section 804 also includes a second outer wall portion 832. Second outer wall portion 832 intersects second inner wall 816 at respective second intermediate corner 836. Housing second section 808 includes third outer wall portion 840. Housing second section 808 also includes fourth outer wall portion 844. Fourth outer wall portion 844 intersects third outer wall portion 840 at respective outer corner 848. Outer corner 848 thus is spaced from inner corner 820 in general opposition thereto. Housing first section 804 and housing second section 808 are permanently joined in a suitable manner. In the illustrated embodiment, housing first section 804 and housing second section 808 are joined together by welding along two intersecting weld seams (not shown) at abutting edges of bottom 852 and along two intersecting weld seams (not shown) at respective abutting edges of first outer wall portion 824 with third outer wall portion 840 and second outer wall portion 832 with fourth outer wall portion 844. Housing first section 804 and housing second corner section 808 when permanently joined thus cooperate to form the security housing 802. In the illustrated embodiment, security housing 802 is joined to the respective longitudinal member (not shown) and cross member (not shown) by weld seams at respective intersecting surfaces.

Figure 20:
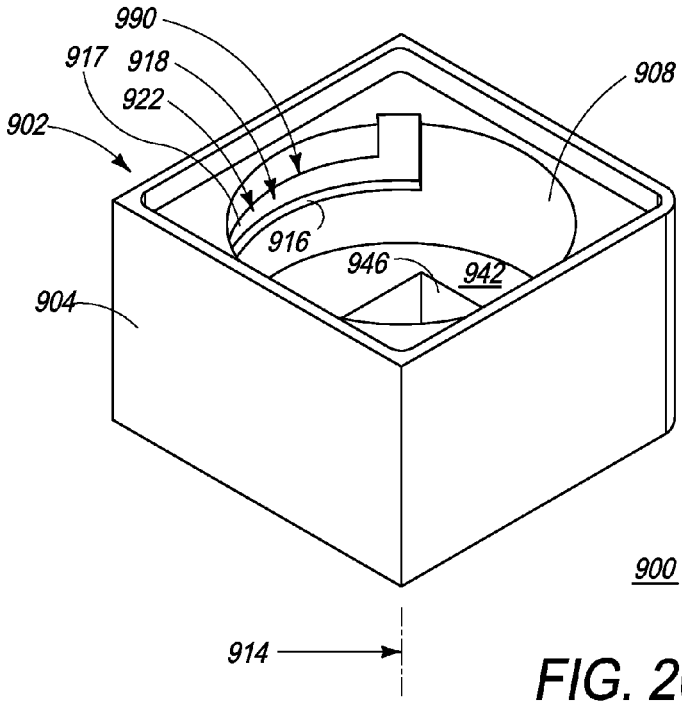
FIG. 20 is a partial view taken from the opposite perspective of FIG. 17.
Figure 12:
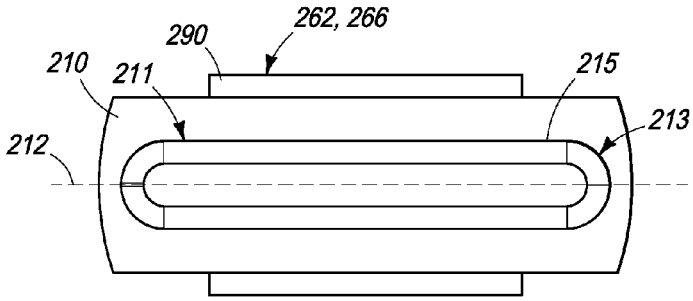
FIG. 12 is a side view of the twist lock taken generally along line 12-12 in FIG. 11.
Figure 13:
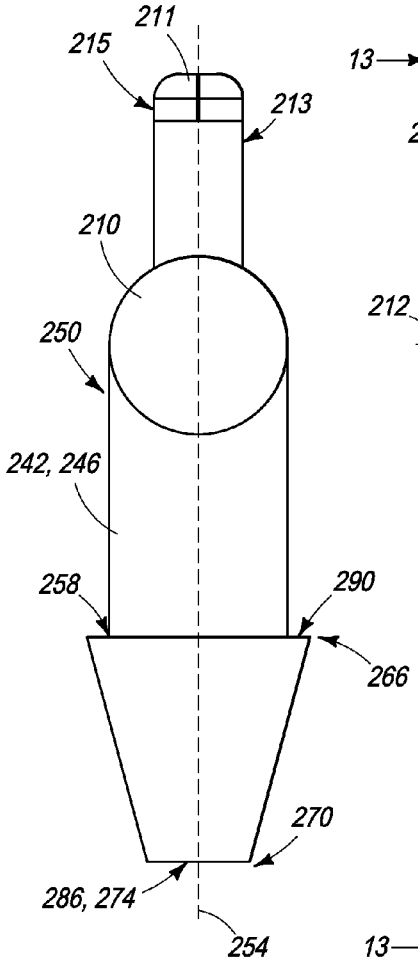
FIG. 13 is a top view of the twist lock taken generally along line 13-13 in FIG. 11.
Figure 11:
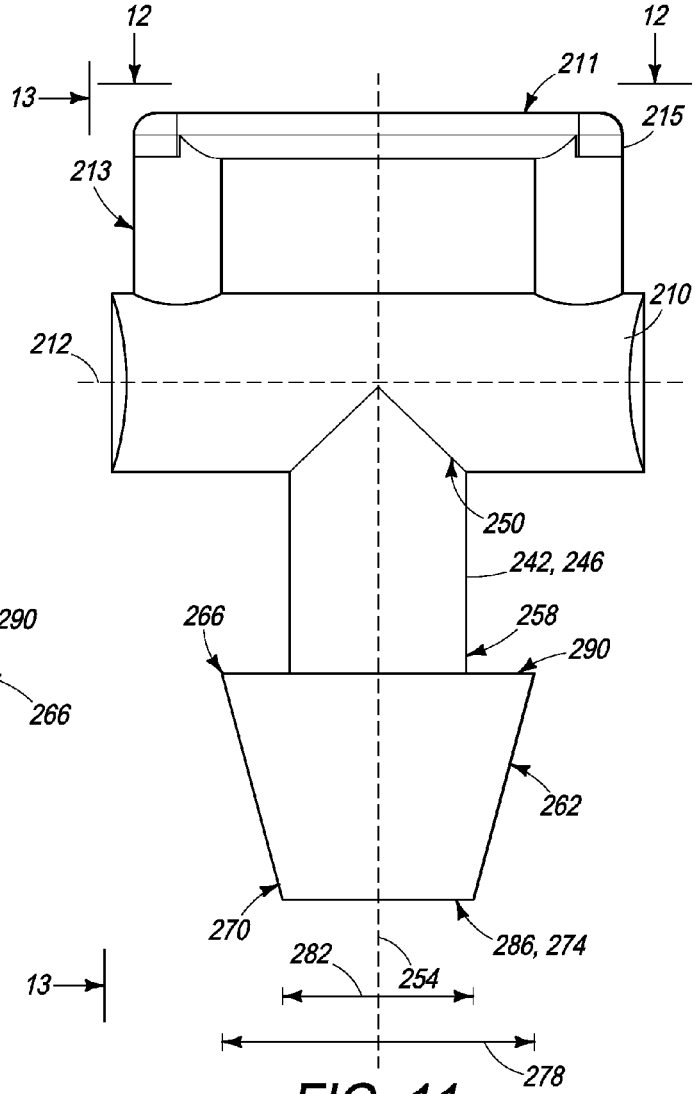
FIG. 11 is an enlarged, isolated end view of the twist lock taken generally along line 11-11 in FIG. 7.
Figure 14:
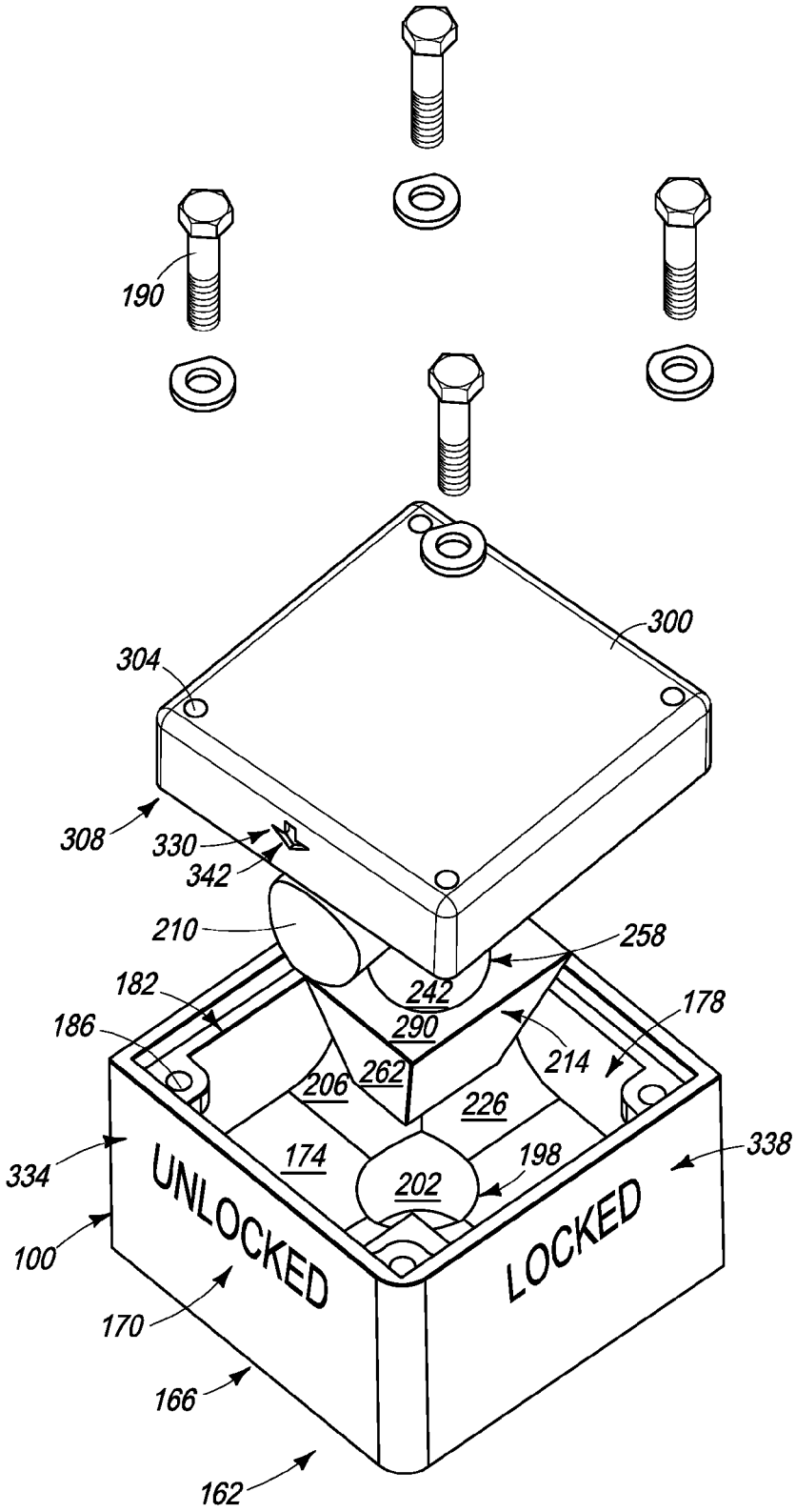
FIG. 14 is an exploded partial perspective view of the twist lock, security housing, security cover and visual indicia in the unlocked position.
Figure 17:
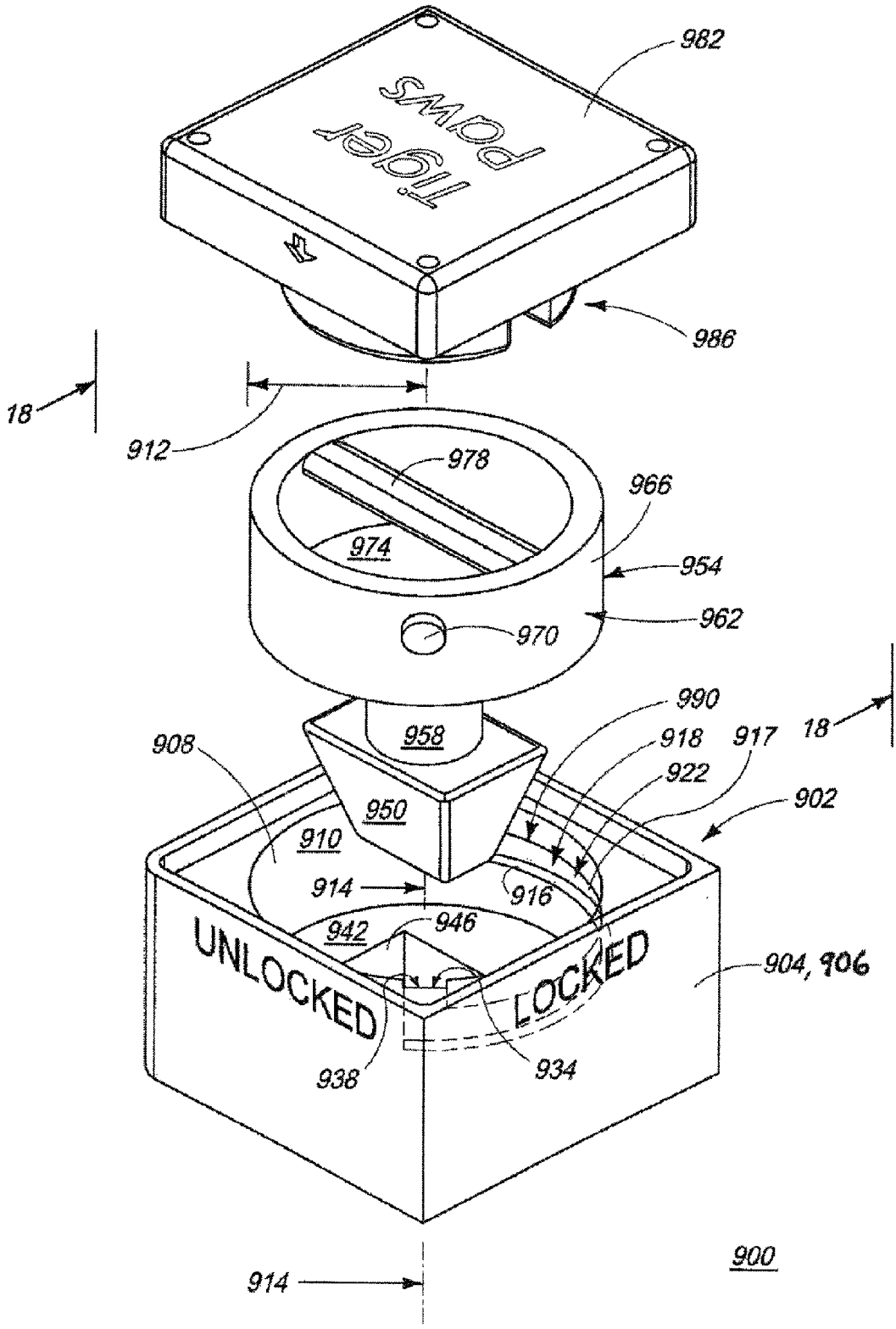
FIG. 17 is an exploded partial perspective view of the twist lock, security housing, security cover and visual indicia in a third alternative embodiment.
Figure 18:
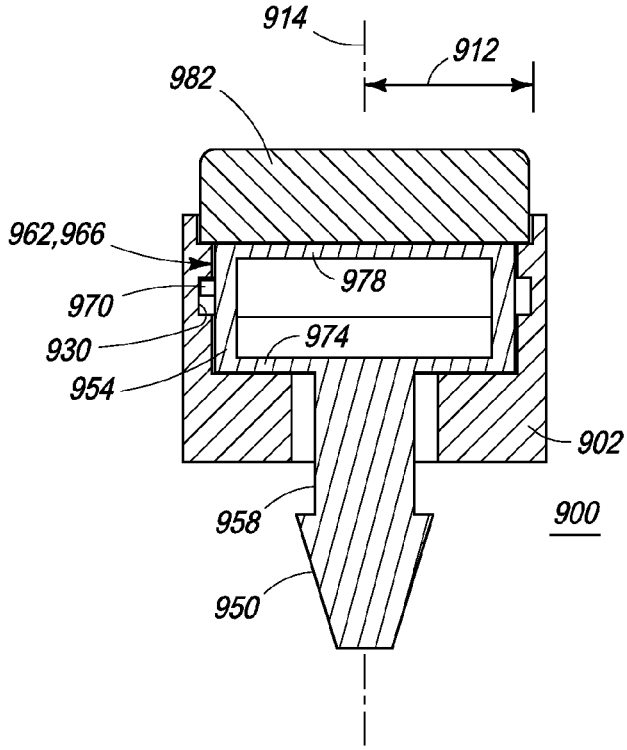
FIG. 18 is a partial cross sectional view taken generally along line 18-18 in FIG. 17 and showing the twist lock and security cover in the unlocked position.
Figure 19:
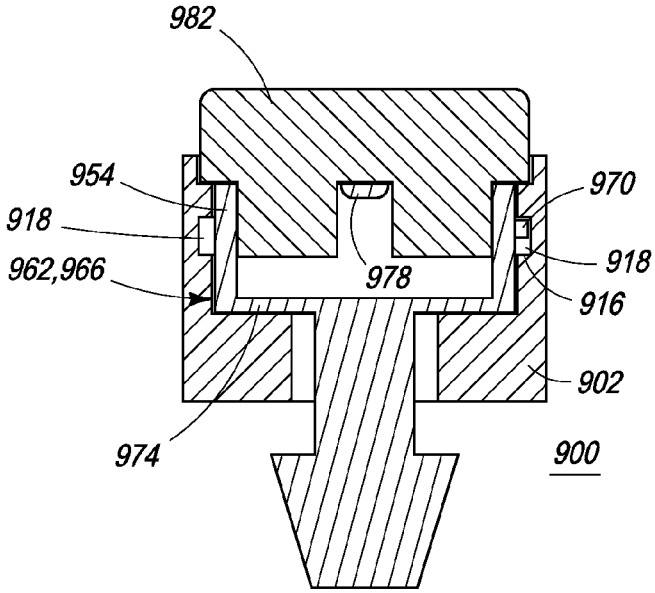
FIG. 19 is a partial cross sectional view identical to FIG. 18, except showing the twist lock and security cover in the locked position.

FIG. 17 is an exploded partial perspective view of the twist lock, security housing, security cover and visual indicia in a third alternative embodiment. FIG. 18 is a partial cross sectional view taken generally along line 18-18 in FIG. 17 and showing the twist lock and security cover in the unlocked position. FIG. 19 is a partial cross sectional view identical to FIG. 17, except showing the twist lock and security cover in the locked position. Spreader frame 900 shown in FIG. 17, FIG. 18, FIG. 19 and FIG. 20 is identical to previously described spreader frame 100 except as otherwise set forth herein. Spreader frame 900 includes a rigid frame structure (not shown) having a plurality of security housings 902 each located at the respective corners thereof. Each security housing 902 includes a set of adjoining walls 906 which cooperate to define a cylindrical compartment 908, as further described. Cooperation of adjoining walls 904 defines a continuous inner wall 910. Inner wall 910 has a primary radius 912 relative to a vertical axis 914. Compartment 908 thus defined by inner wall 910 also has a primary radius 912 relative to vertical axis 914. Inner wall 910 has therein a recessed groove 916 (FIG. 20). Recessed groove 916 has a rear wall 917 spaced slightly in the outward radial direction from inner wall 910. Recessed groove 916 thus defines a race 918. Race 918 includes a major portion 922. Major portion 922 extends from a terminus in the horizontal direction to a vertical transition 930. Race 918 also includes a minor section 934 extending in the vertical direction from vertical transition 930 and upwardly to an external opening or mouth 938. Horizontal major portion 922 and vertical transition 930 thus are lower than vertical minor portion 934 and mouth 938. Race 918 has a substantially uniform width along the length thereof.

Security housing 902 also includes a flat bottom wall 942. Bottom wall 942 cooperates with inner wall 910 to define a lower end of cylindrical compartment 908. Bottom wall 942 has defined therein central opening 946. It is to be understood that, in the specific arrangement shown in FIG. 17, central opening 946 is sized to permit key section 950 of twist lock 954 to be inserted there through when twist lock 954 is rotated about the vertical axis 914 to the unlocked position (shown in FIG. 17 and FIG. 18). Twist lock 954 thus can be inserted into and completely removed from central opening 946 and security housing 902 when rotated to the unlocked position. When rotated to the locked position (see FIG. 19), twist lock 954 engages the lifting block (not shown) of a cargo container as previously described. In other arrangements (not shown), central opening 946 is sized to permanently capture twist lock 954 and thus prevents removal of twist lock 954 from security housing 902.

Twist lock 954 includes spindle section 958 intermediate key section 950 and locking member 962. Locking member 962 is adapted to be received in race 918 of recessed groove 916. Locking member 962 is movable from the unlocked position at mouth 938 and downward through vertical minor section 934 to vertical transition 930. Locking member 962 thus remains in the unlocked position throughout vertical minor section 934 and vertical transition 930. Locking member 962 when rotated from the unlocked position to the locked position moves ninety degrees from the vertical transition 930 through the major section 922 to the terminus 926. With twist lock 954 in the locked position, key section 950 engages the lifting block (not shown) for hoisting the cargo container as previously described. Locking member 962 thus is adapted to interact with the recessed groove 916 of security housing 902 to lock or retain twist lock 954 alternatively in either the locked position or the unlocked position.

Locking member 962 can be of any specific construction suitable to be received in race 918 of recessed groove 916 for movement between the unlocked and locked positions. In the specific arrangement shown in FIG. 17, FIG. 18 and FIG. 19, locking member 962 includes a continuous cylindrical wall 966 having thereon a horizontal projection 970. Horizontal projection 970 extends outwardly from cylindrical wall 966 and is sized to be received in race 918 of recessed groove 916. Cylindrical wall 966 is supported relative to spindle section 958 by radial connecting member 974. Locking member 962 includes handle 978 spaced in the vertical direction from connecting member 974. Handle 978 extends between opposite points on cylindrical wall 966 and thus permits manual handling of twist lock 954 by personnel. In the specific arrangement illustrated, handle 978 is received by security cover 982. Security cover 982 is adapted to receive and engage handle 978 when twist lock 954 is in the locked position (see FIG. 19). Security cover 982 thus is adapted to maintain twist lock 954 in the locked position. Alternatively, security cover 982 receives and engages handle 978 when twist lock 954 is in the unlocked position (see FIG. 18). Security cover 982 thus is adapted to maintain twist lock 954 in the unlocked position.

Figure 21:
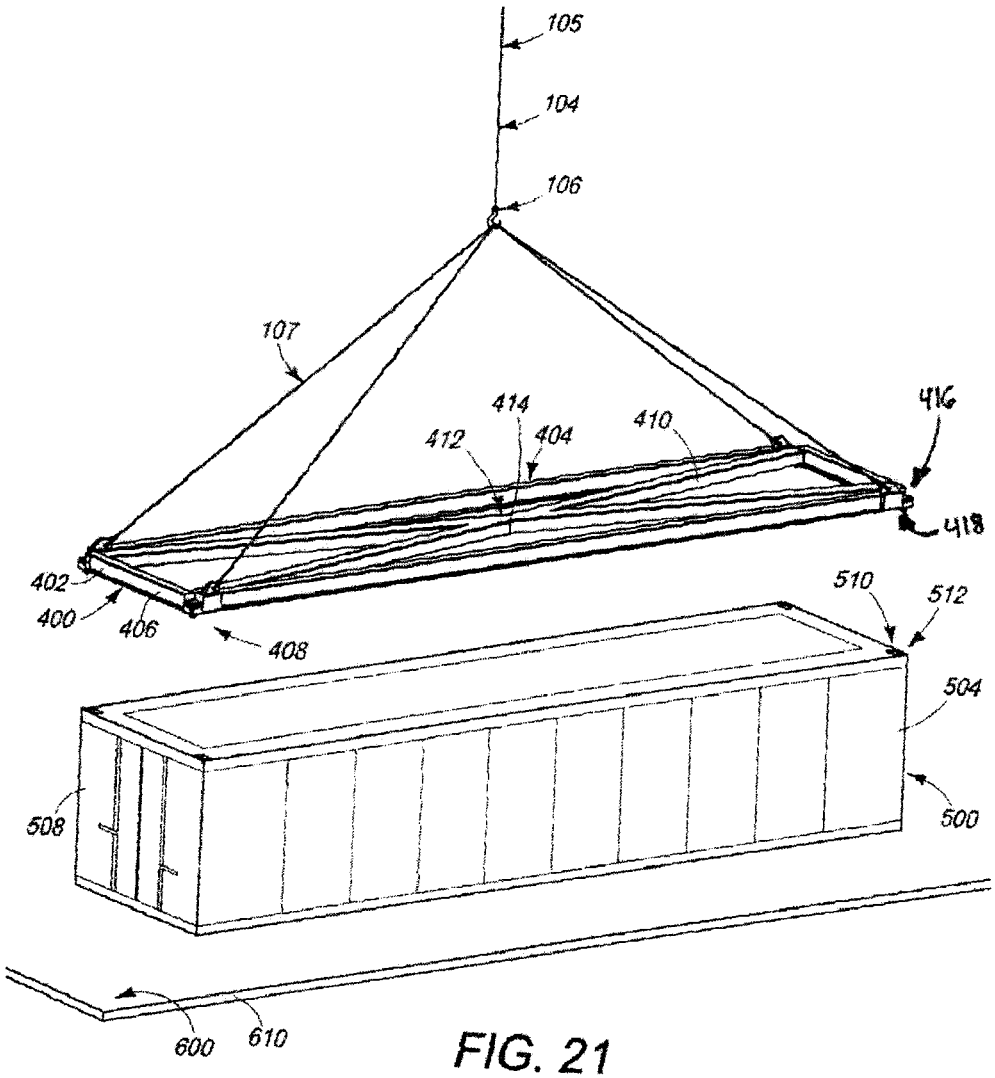
FIG. 21 is a perspective view of a spreader frame according to an embodiment.

FIG. 21 is a perspective view of a spreader frame 400 according to an embodiment. Spreader frame 400 is identical to previously described spreader frame 100 except as otherwise described herein. Spreader frame 400 is adapted to support a container 500 as previously described. Spreader frame 400 includes a rigid frame structure 402. Rigid frame structure 402 has suitable mechanical strength to support with an adequate safety factor the container 500 when fully loaded. It is to be understood that the rigid frame structure 402 can be constructed in any manner suitable to provide mechanical strength adequate to support the container 500 when fully loaded. In the specific embodiment illustrated in FIG. 21, the rigid frame structure 402 includes a pair of parallel elongated longitudinal frame members 404. The rigid frame structure 402 includes a spaced pair of end members 406 joining the pair of longitudinal frame members 404 at opposite ends thereof. Each end member 406 extends between the pair of longitudinal frame members 404 in perpendicular relation thereto. The end members 406 and longitudinal frame members 404 thus cooperate to define a generally rectangular outer perimeter having four corners 408 disposed respectively in two opposite pairs. The rigid frame structure 402 includes a pair of intersecting, elongated x-brace members 410. Each x-brace member 410 extends between a respective opposite pair of corners 408. Respective ends of each x-brace member 410 are joined at respective corners 408 in a suitable manner. Intermediate corners 408 the pair of x-brace members 410 intersect in an x-intersection 412 at center 414 of the rectangular outer perimeter of rigid frame structure 402. It is to be understood that the x-brace members 410 and x-intersection 412 can be constructed and joined in any suitable manner. It is anticipated that in some specific embodiments, x-brace members 410 will not be of identical construction. The rigid frame structure 402 also includes four security housings 416 each disposed at a respective corner 408. The security housings 416 cooperate with respective twist locks 418 to support the container 500 as previously described. Rigid frame structure 402 has fewer intersecting members than previously described rigid frame structure 100 and thus can be manufactured with fewer welds or other suitable joining operations.

Figure 22:
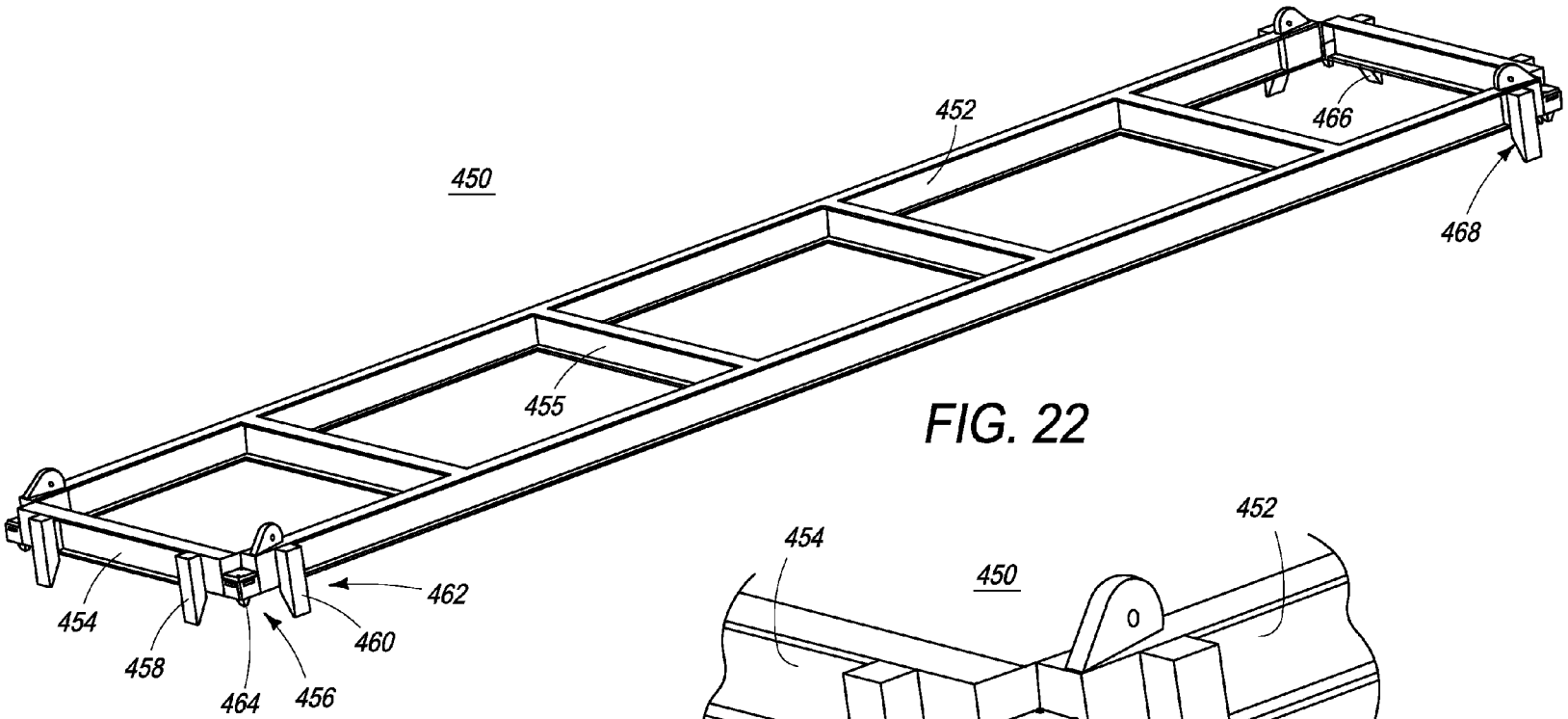
FIG. 22 is a perspective view of a spreader frame according to an embodiment.
Figure 23:
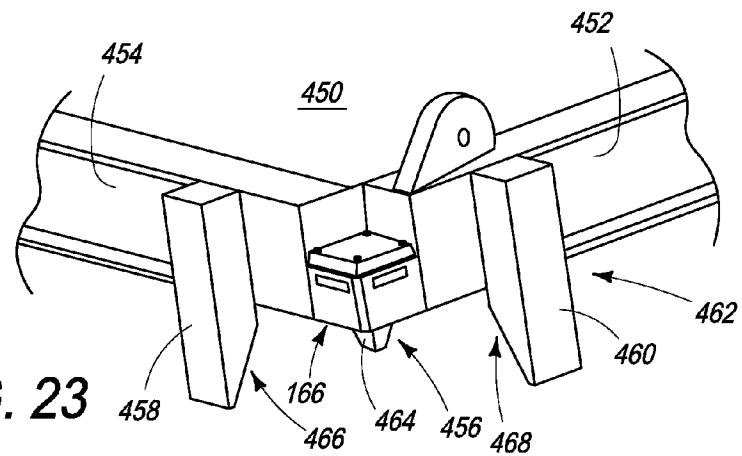
FIG. 23 is an enlarged partial perspective view partial perspective view of a corner of the spreader frame of FIG. 22.

FIG. 22 is a perspective view of a spreader frame 450 according to an embodiment. Spreader frame 450 is identical to previously described spreader frame 100 except as otherwise described herein. Spreader frame 450 includes a pair of parallel, elongated longitudinal frame members 452 intersected by a pair of end members 454 extending perpendicular thereto. A plurality of cross members 455 are disposed intermediate end members 454 as previously described. Longitudinal frame members 452 and end members 454 are adjoined at respective corners 456. Spreader frame 450 includes a plurality of spaced longitudinal alignment members 458 each mounted on a respective end member 454 for finding and aligning with a respective end wall (not shown) of a container (not shown). Spreader frame 450 includes a plurality of spaced side alignment members 460 each mounted on a respective longitudinal frame member 452 for finding and aligning with a respective side wall (not shown) of the container. In the specific embodiment illustrated in FIG. 22, spreader frame 450 includes four of the longitudinal alignment members 458 and four side alignment members 460. In the specific embodiment illustrated and as shown in FIG. 23, one of the longitudinal alignment members 458 and a respective one of the side alignment members 460 are disposed in a respective alignment pairing 462 adjacent a respective corner 456. The longitudinal alignment member 458 and side alignment member 460 of each alignment pairing 462 cooperate with the respective end wall and side wall of the container and thus find and align respective corner 456 with a respective lifting block (not shown) of the container. The spreader frame 450 thus includes four alignment pairings 462 which each cooperate with the container to align a respective twist lock 464 with the respective opening (not shown) of the respective lifting block of the container. The alignment pairings 462 thus cooperate with the container to align each twist lock 464 with the opening of each respective lifting block of the container. The alignment pairings 462 thus improve and speed alignment of the twist locks 464 with the lifting blocks for being attached to and supporting the container to be hoisted.

As can best be appreciated in FIG. 23, each alignment pairing 462 is mounted outboard of the respective supporting member in order to transfer horizontal forces from the spreader frame 450 to the container. More particularly, in each alignment pairing 462 the respective longitudinal alignment member 458 is mounted on the outer side or outboard of the respective end member 454. The longitudinal alignment member 458 has an inner surface or stop 466 which stops against the end wall of the container when either the spreader frame 450 or the container is subject to horizontal force in the respective longitudinal direction. Also, in each alignment pairing 462 the respective lateral alignment member 460 is mounted on the outer side or outboard of the respective longitudinal frame member 452. The lateral alignment member 460 has an inner surface or stop 468 which stops against the side wall of the container when either the spreader frame 450 or the container is subject to horizontal force in the respective lateral direction. The alignment pairings 462 being mounted outboard of the respective supporting members 452,454 thus prevent the twist locks 464 from being subjected to excessive horizontal forces when the container or spreader frame 450 experiences a collision.

Embodiments provide a spreader frame for hoisting a container which prevents the twist locks from being unintentionally or accidentally rotated to the open position before the container is hoisted or while the container is suspended from the hoist. Embodiments provide a spreader frame for hoisting a container wherein only vertical forces are applied to the container and twist locks when the container is suspended from the spreader frame. Embodiments provide a spreader frame which is connected to hoist equipment and to a container to permit the container to be safely hoisted from a supply boat to an off-shore oil platform even though slack is introduced into the hoist cable or wire rope slings. Embodiments provide a spreader frame which includes a safety feature that requires personnel acting deliberately with a tool to gain access to the twist locks to unlock or lock the spreader frame and container.

CONCLUSION

A spreader frame for hoisting a container is described. Although specific embodiments are illustrated and described herein, it will be appreciated by those of ordinary skill in the art that any arrangement which is calculated to achieve the same purpose may be substituted for the specific embodiments shown. This application is intended to cover any adaptations or variations. For example, although described in terms of a spreader frame, one of ordinary skill in the art will appreciate that implementations can be made for other apparatus that provide the required function. One of skill in the art will recognize that embodiments having different dimensions and lengths can be constructed for use with containers of any desired size. For example, specific embodiments can be constructed for use with commonly used containers which are forty feet in length, or longer if desired, or shorter, such as six feet in length, if desired.

In particular, one of skill in the art will readily appreciate that the names of the apparatus are not intended to limit embodiments. Furthermore, additional apparatus can be added to the components, functions can be rearranged among the components, and new components to correspond to future enhancements and physical devices used in embodiments can be introduced without departing from the scope of embodiments. One of skill in the art will readily recognize that embodiments are applicable to future spreader frames and containers, different materials, different hoist equipment, and new container designs. The terminology used in this application is meant to include all environments and alternate technologies which provide the same functionality as described herein.

I claim:

1. A spreader frame adapted for hoisting a container, the container having at least one lifting block, the spreader frame comprising:

a rigid frame structure;

a twist lock received by the rigid frame structure, the twist lock being rotated relative to the rigid frame structure between a locked position to engage the lifting block and an unlocked position to disengage from the lifting block;

a safety feature which cooperates with at least one of the rigid frame structure and the twist lock to retain the twist lock in the locked position from being rotated relative to the rigid frame structure absent personnel changing a position of the safety feature;

a security cover received by the rigid frame structure, at least one of the rigid frame structure, twist lock and security cover including the safety feature; and the safety feature including one of the security cover and the twist lock having a projection, the safety feature including the other of the security cover and the twist lock having a retaining recess which receives the projection to prevent the twist lock from being rotated relative to the rigid frame structure.

2. The spreader frame of claim 1 and further comprising:

the safety feature being movable relative to at least one of the rigid frame structure and the twist lock between a first position and a second position, and the safety feature being fixed in one of the first position and the second position absent personnel using a tool to move the safety feature to the other of the first position and the second position.

3. The spreader frame of claim 2 and further comprising:

the safety feature being fixed relative to at least one of the rigid frame structure and the twist lock by at least one fastener.

4. The spreader frame of claim 1 and further comprising:

visual safety indicia adapted to provide personnel observing the spreader frame a visual indication whether the twist lock is retained in the locked position by the safety feature.

5. The spreader frame of claim 1 and further comprising:

the rigid frame structure including spaced corners, the rigid frame structure including an alignment member for aligning at least one of the corners with a lifting block of a container.

6. The spreader frame of claim 5 and further comprising:

the rigid frame structure including at least one alignment pairing, each alignment pairing having at least two alignment members for aligning a respective corner with a lifting block of a container.

7. A spreader frame for hoisting a container, the container having at least one lifting block, said spreader frame comprising:

a rigid frame structure;

a twist lock received by the rigid frame structure, the twist lock being rotated relative to the rigid frame structure between a locked position to engage the lifting block and an unlocked position to disengage from the lifting block;

a safety feature which cooperates with at least one of the rigid frame structure and the twist lock to prevent the twist lock in the locked position and in the unlocked position from being rotated relative to the rigid frame structure absent personnel changing a position of the safety feature;

a security cover received by the rigid frame structure, at least one of the rigid frame structure, twist lock and security cover including the safety feature; and the safety feature including one of the security cover and the twist lock having a projection, the safety feature including the other of the security cover and the twist lock having a retaining recess which receives the projection to prevent the twist lock from being rotated relative to the rigid frame.

8. The spreader frame of claim 7 and further comprising:

the safety feature being movable relative to at least one of the rigid frame structure and the twist lock between a first position and a second position, and the safety feature being fixed in one of the first position and the second position absent personnel using a tool to move the safety feature to the other of the first position and the second position.

9. The spreader frame of claim 8 and further comprising:

the safety feature being fixed relative to at least one of the rigid frame structure and the twist lock by at least one fastener.

10. The spreader frame of claim 7 and further comprising:

visual safety indicia adapted to provide personnel observing the spreader frame a visual indication whether the twist lock is retained in the locked position or the unlocked position by the safety feature.

11. The spreader frame of claim 7 and further comprising:

the rigid frame structure including spaced corners, the rigid frame structure including an alignment member for aligning at least one of the corners with a lifting block of a container.

12. The spreader frame of claim 11 and further comprising:

the rigid frame structure including at least one alignment pairing, each alignment pairing having at least two alignment members for aligning a respective corner with a lifting block of a container.

13. A spreader frame for hoisting a container, the container having at least one lifting block, said spreader frame comprising:

a rigid frame structure;

a twist lock received by the rigid frame structure, the twist lock being rotated relative to the rigid frame structure between a locked position to engage the lifting block and an unlocked position to disengage from the lifting block;

a security cover received by the rigid frame structure;

a safety feature included by at least one of the rigid frame structure, twist lock and security cover, the safety feature cooperating with at least one of the rigid frame structure and the twist lock to prevent the twist lock in the locked position and in the unlocked position from being rotated relative to the rigid frame structure, the safety feature being movable relative to at least one of the rigid frame structure and the twist lock between a first position and a second position, the safety feature being fixed in one of the first position and the second position absent personnel using a tool to move the safety feature to the other of the first position and the second position; and visual safety indicia adapted to provide personnel observing the spreader frame a visual indication whether the twist lock is retained in the locked position or the unlocked position by the safety feature.

14. The spreader frame of claim 13 and further comprising:

the safety feature including one of the security cover and the twist lock having a projection, the safety feature including the other of the security cover and the twist lock having a retaining recess which receives the projection to prevent the twist lock from being rotated relative to the rigid frame.

15. The spreader frame of claim 13 and further comprising:

the safety feature being fixed relative to at least one of the rigid frame structure and the twist lock by at least one fastener.

16. The spreader frame of claim 13 and further comprising:

the rigid frame structure including spaced corners, the rigid frame structure including an alignment member for aligning at least one of the corners with a lifting block of a container.

17. The spreader frame of claim 16 and further comprising:

the rigid frame structure including at least one alignment pairing, each alignment pairing having at least two alignment members for aligning a respective corner with a lifting block of a container.

* * * * *